US008191635B2

(12) United States Patent
Buske et al.

(10) Patent No.: US 8,191,635 B2
(45) **Date of Patent: *Jun. 5, 2012**

(54) HOLE OPENER WITH HYBRID REAMING SECTION

(75) Inventors: Robert J. Buske, The Woodlands, TX (US); Rudolf C. Pessier, Galveston, TX (US)

(73) Assignee: Baker Hughes Incorporated, Houston, TX (US)

( * ) Notice: Subject to any disclaimer, the term of this patent is extended or adjusted under 35 U.S.C. 154(b) by 263 days.

This patent is subject to a terminal disclaimer.

(21) Appl. No.: 12/574,542

(22) Filed: Oct. 6, 2009

(65) Prior Publication Data

US 2011/0079441 A1 Apr. 7, 2011

(51) Int. Cl.
*E21B 10/14* (2006.01)

(52) U.S. Cl. ..... 166/335; 166/336

(58) Field of Classification Search ..... 175/334, 175/335, 336, 385, 386
See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,399,831 | A | 12/1921 | Wadsworth |
| 1,519,641 | A | 12/1924 | Thompson |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |
| 1,932,487 | A | 10/1933 | Scott |
| 2,030,722 | A | 2/1936 | Scott |
| 2,058,628 | A | 10/1936 | Reed |
| 2,086,680 | A | 7/1937 | Scott et al. |
| 2,103,583 | A | 12/1937 | Howard et al. |
| 2,117,481 | A | 5/1938 | Howard et al. |
| 2,119,618 | A | 6/1938 | Zublin |

(Continued)

FOREIGN PATENT DOCUMENTS

| | | |
|---|---|---|
| DE | 13 01 784 | 8/1969 |

(Continued)

OTHER PUBLICATIONS

Beijer, G., International Preliminary Report on Patentability for International Patent Application No. PCT/US2009/042514, The International Bureau of WIPO, dated Nov. 2, 2010.

(Continued)

*Primary Examiner* — William P Neuder
(74) *Attorney, Agent, or Firm* — Sutton, McAughan, Deaver, PLLC

(57) ABSTRACT

A hole opener having a hybrid reaming section for downhole earth boring operations may include a reamer body having an axis of rotation, an outer periphery, and upper and lower ends, a plurality of rolling cutters coupled to the outer periphery and depending downwardly, the rolling cutters defining a rolling cutter cutting profile having a cutting diameter, a plurality of fixed blade cutters coupled to the outer periphery and defining a fixed blade cutter cutting profile having a cutting diameter, each fixed blade cutter being coupled between adjacent rolling cutters. At least one of the rolling cutters may be asymmetrically coupled about the axis. The cutting diameter of the rolling cutter cutting profile may be larger than the cutting diameter of the fixed blade cutter cutting profile. At least a portion of the rolling cutter cutting profile may be deeper than the fixed blade cutter cutting profile.

17 Claims, 15 Drawing Sheets

U.S. PATENT DOCUMENTS

| | | | |
|---|---|---|---|
| 2,198,849 | A | 4/1940 | Waxier |
| 2,216,894 | A | 10/1940 | Stancliff |
| 2,244,537 | A | 6/1941 | Kammerer |
| 2,249,926 | A | 7/1941 | Zublin |
| 2,297,157 | A | 9/1942 | McClinton |
| 2,320,136 | A | 5/1943 | Kammerer |
| 2,320,137 | A | 5/1943 | Kammerer |
| 2,380,112 | A | 7/1945 | Kinnear |
| RE23,416 | E | 10/1951 | Kinnear |
| 2,719,026 | A | 9/1955 | Boice |
| 2,815,932 | A | 12/1957 | Wolfram |
| 2,994,389 | A | 8/1961 | Bus, Sr. |
| 3,010,708 | A | 11/1961 | Hlinsky et al. |
| 3,050,293 | A | 8/1962 | Hlinsky |
| 3,055,443 | A | 9/1962 | Edwards |
| 3,066,749 | A | 12/1962 | Hildebrandt |
| 3,126,066 | A | 3/1964 | Williams, Jr. |
| 3,126,067 | A | 3/1964 | Schumacher, Jr. |
| 3,174,564 | A | 3/1965 | Morlan |
| 3,239,431 | A | 3/1966 | Raymond |
| 3,250,337 | A | 5/1966 | Demo |
| 3,269,469 | A | 8/1966 | Kelly, Jr. |
| 3,285,355 | A | 11/1966 | Neilson et al. |
| 3,386,521 | A | 6/1968 | Chadderdon et al. |
| 3,387,673 | A | 6/1968 | Thompson |
| 3,424,258 | A | 1/1969 | Nakayama |
| 3,583,501 | A | 6/1971 | Aalund |
| RE28,625 | E | 11/1975 | Cunningham |
| 3,917,011 | A | 11/1975 | Hester |
| 4,006,788 | A | 2/1977 | Garner |
| 4,036,314 | A | 7/1977 | Dixon et al. |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,386,669 | A | 6/1983 | Evans |
| 4,410,284 | A | 10/1983 | Herrick |
| 4,428,687 | A | 1/1984 | Zahradnik |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,706,765 | A | 11/1987 | Lee et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,976,324 | A | 12/1990 | Tibbitts |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,429,201 | A | 7/1995 | Saxman |
| 5,439,068 | A | 8/1995 | Huffstutler et al. |
| 5,452,771 | A | 9/1995 | Blackman et al. |
| 5,467,836 | A | 11/1995 | Grimes et al. |
| 5,472,057 | A | 12/1995 | Winfree |
| 5,472,271 | A | 12/1995 | Bowers et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,560,440 | A | 10/1996 | Tibbitts |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,116,357 | A | 9/2000 | Wagoner et al. |
| 6,173,797 | B1 | 1/2001 | Dykstra et al. |
| 6,220,374 | B1 | 4/2001 | Crawford |
| 6,241,034 | B1 | 6/2001 | Steinke et al. |
| 6,241,036 | B1 | 6/2001 | Lovato et al. |
| 6,250,407 | B1 | 6/2001 | Karlsson |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,345,673 | B1 | 2/2002 | Siracki |
| 6,360,831 | B1 | 3/2002 | Akesson et al. |
| 6,367,568 | B2 | 4/2002 | Steinke et al. |
| 6,386,298 | B1 | 5/2002 | Smith et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,460,635 | B1 | 10/2002 | Kalsi et al. |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |

| | | | |
|---|---|---|---|
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,197,806 | B2 | 4/2007 | Boudreaux et al. |
| 7,198,119 | B1 | 4/2007 | Hall et al. |
| 7,234,550 | B2 | 6/2007 | Azar et al. |
| 7,270,196 | B2 | 9/2007 | Hall |
| 7,281,592 | B2 | 10/2007 | Runia et al. |
| 7,320,375 | B2 | 1/2008 | Singh |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,568,534 | B2 | 8/2009 | Griffin et al. |
| 7,621,346 | B1 | 11/2009 | Trinh et al. |
| 7,621,348 | B2 | 11/2009 | Hoffmaster et al. |
| 7,703,556 | B2 | 4/2010 | Smith et al. |
| 7,703,557 | B2 | 4/2010 | Durairajan et al. |
| 7,819,208 | B2 | 10/2010 | Pessier et al. |
| 7,836,975 | B2 | 11/2010 | Chen et al. |
| 7,845,435 | B2 | 12/2010 | Zahradnik et al. |
| 7,845,437 | B2 | 12/2010 | Bielawa et al. |
| 7,847,437 | B2 | 12/2010 | Chakrabarti et al. |
| 2002/0092684 | A1 | 7/2002 | Singh et al. |
| 2002/0108785 | A1 | 8/2002 | Slaughter, Jr. et al. |
| 2004/0060741 | A1 | 4/2004 | Shipalesky et al. |
| 2004/0099448 | A1 | 5/2004 | Fielder et al. |
| 2004/0238224 | A1 | 12/2004 | Runia |
| 2005/0087370 | A1 | 4/2005 | Ledgerwood, III et al. |
| 2005/0103533 | A1 | 5/2005 | Sherwood, Jr. et al. |
| 2005/0178587 | A1 | 8/2005 | Witman, IV et al. |
| 2005/0183892 | A1 | 8/2005 | Oldham et al. |
| 2005/0263328 | A1 | 12/2005 | Middlemiss |
| 2005/0273301 | A1 | 12/2005 | Huang |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0260848 | A1 | 11/2006 | Fyfe |
| 2006/0266558 | A1 | 11/2006 | Middlemiss et al. |
| 2006/0266559 | A1 | 11/2006 | Keshavan et al. |
| 2006/0278442 | A1 | 12/2006 | Kristensen |
| 2006/0283640 | A1 | 12/2006 | Estes et al. |
| 2007/0029114 | A1 | 2/2007 | Middlemiss |
| 2007/0062736 | A1 | 3/2007 | Cariveau et al. |
| 2007/0079994 | A1 | 4/2007 | Middlemiss |
| 2007/0187155 | A1 | 8/2007 | Middlemiss |
| 2007/0221417 | A1 | 9/2007 | Hall et al. |
| 2008/0066970 | A1 | 3/2008 | Zahradnik et al. |
| 2008/0264695 | A1 | 10/2008 | Zahradnik et al. |
| 2008/0296068 | A1 | 12/2008 | Zahradnik et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0183925 | A1 | 7/2009 | Zhang et al. |
| 2009/0218140 | A1 | 9/2009 | Pessier et al. |
| 2009/0272582 | A1 | 11/2009 | McCormick et al. |
| 2010/0224417 | A1 | 9/2010 | Zahradnik et al. |
| 2010/0276205 | A1 | 11/2010 | Oxford et al. |
| 2010/0288561 | A1 | 11/2010 | Zahradnik et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1* | 4/2011 | Buske et al. ..... 175/336 |
| 2011/0079443 | A1 | 4/2011 | Buske et al. |
| 2011/0162893 | A1 | 7/2011 | Zhang |

FOREIGN PATENT DOCUMENTS

| | | |
|---|---|---|
| EP | 0225101 | 6/1987 |
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Kang, K.H., International Search Report for International Patent Application No. PCT/US2010/033513, Korean Intellectual Property Office, dated Jan. 10, 2011.

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

International Search Report for International patent application No. PCT/US2008/083532.
Written Opinion for International patent application No. PCT/US2008/083532.
Sheppard, N. and Dolly, B. "Rock Drilling—Hybrid Bit Success for Syndax3 Pins." Industrial Diamond Review, Jun. 1993, pp. 309-311.
Tomlinson, P. and Clark, I. "Rock Drilling—Syndax3 Pins-New Concepts in PCD Drilling." Industrial Diamond Review, Mar. 1992, pp. 109-114.
Williams, J. and Thompson, A. "An Analysis of the Performance of PDC Hybrid Drill Bits." SPE/IADC 16117, SPE/IADC Drilling Conference, Mar. 1987, pp. 585-594.
Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.
Smith Services. "Hole Opener—Model 6980 Hole Opener." [retrieved from the Internet on May 7, 2008 using <URL: http://www.siismithservices.com/b_products/product_page.asp?ID=589>].
Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].
Ersoy, A. and Waller, M. "Wear characteristics of PDC pin and hybrid core bits in rock drilling." Wear 188, Elsevier Science S.A., Mar. 1995, pp. 150-165.
Buske, R., Rickabaugh, C., Bradford, J., Lukasewich H., and Overstreet, J. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.
Wells, Dr. M., Marvel, T., and Beuershausen, C. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
George, B., Grayson, E., Lays, R., Felderhoff, F., Doster, M., and Holmes, M. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.
Georgescu, M., International Search Report for International Patent Application No. PCT/US2010/051019, dated Jun. 6, 2011, European Patent Office.
Georgescu, M., Written Opinion for International Patent Application No. PCT/US2010/051019, dated Jun. 6, 2011, European Patent Office.
Georgescu, M., International Search Report for International Patent Application No. PCT/US2010/051020, dated Jun. 1, 2011, European Patent Office.
Georgescu, M., Written Opinion for International Patent Application No. PCT/US2010/051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US2010/051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.
Becamel, P., International Preliminary Report on Patentability, dated Jan. 5, 2012, The International Bureau of WIPO, Switzerland.

* cited by examiner

HOLE OPENER WITH HYBRID REAMING SECTION

CROSS REFERENCE TO RELATED APPLICATIONS

This application is related to co-pending U.S. application Ser. Nos. 12/574,513, 12/574,549, and 12/574,560, each having the same filing date and title, and each of which is incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relates generally to tools for reaming subterranean wellbores; and more specifically relates to reamer tools having a combination of rolling and fixed cutters and related methods.

2. Description of the Related Art

Drill bits used in drilling of subterranean wellbores typically comprise fixed cutter bits or rolling cutter bits. Rolling cutter bits typically include a body having legs extending downward and a head bearing extending from the leg towards the axis of the bit body. Frusto-conically shaped rolling cutters are rotatably mounted on each of these journals and are included with cutting teeth on the outer surface of these cones. As the bit rotates, the cones rotate to cause the cutting elements to disintegrate the earth formation.

In some situations, a pilot reamer drilling system is employed where two or more bits are combined on a single drill string. Here, the lowermost bit, commonly referred to as a pilot bit, creates a pilot hole and an upper earth boring bit enlarges the pilot hole diameter. The bit enlarging the hole diameter is referred to as a reamer. Typically, the pilot bit comprises a conventional bit, i.e., either a rolling cutter bit or a fixed cutter bit. The reamer bit usually employs rolling cutters as cutting members that are attached to the reamer body. Pilot reamer drilling systems are used to drill large diameter boreholes that may require enhanced stabilization. For example, U.S. Pat. No. 6,386,302 to Beaton discloses a "reamer for drilling a hole having a diameter larger than a pass through diameter [and] in one aspect includes a body having reaming blades affixed at azimuthally spaced apart locations." As another example, U.S. Pat. No. 7,416,036 to Forstner et al., which is assigned to the assignee of the present invention and incorporated herein by reference for all purposes, discloses a "BHA compris[ing] a pilot bit and a reamer above it that is larger in diameter than the suspended liner." As other examples, U.S. Pat. Appl. Pub. No. 2009/0218140 to Pessier et al. discloses a reamer bit comprising "four cutter mounts [with] rolling cutters on each mount" and U.S. Pat. Appl. Pub. No. 2009/0166093 to Pessier et al. discloses a reamer bit having rolling cutters and stabilizer pads on the body, each of which is assigned to the assignee of the present invention and incorporated herein by reference for all purposes. Although each of these bits may be workable for certain limited applications, an improved hybrid reamer with enhanced reaming performance is desirable.

The invention disclosed and taught herein is directed to an improved tool having a hybrid reaming section for reaming a wellbore and to methods of making and using the improved tool.

BRIEF SUMMARY OF THE INVENTION

A hole opener having a hybrid reaming section for downhole earth boring operations may include a reamer body having an axis of rotation, an outer periphery, and upper and lower ends, a plurality of rolling cutter mounts coupled to the outer periphery and depending downwardly, a rolling cutter coupled to each mount, the rolling cutters defining a rolling cutter cutting profile having a rolling cutter cutting diameter, a plurality of fixed blade cutters coupled to the outer periphery and defining a fixed blade cutter cutting profile having a fixed blade cutter cutting diameter, each fixed blade cutter being coupled between adjacent rolling cutter mounts, wherein at least one of the rolling cutters is asymmetrically coupled about the axis, and wherein the rolling cutter cutting diameter is larger than the fixed blade cutter cutting diameter.

A hole opener having a hybrid reaming section for downhole earth boring operations may include a reamer body having a central longitudinal axis of rotation, an outer periphery, and upper and lower ends, a plurality of rolling cutter mounts coupled to the outer periphery about the longitudinal axis and depending downwardly, a rolling cutter rotatably coupled to each mount, the rolling cutters defining a rolling cutter cutting profile having an outermost rolling cutter cutting diameter, a plurality of fixed blade cutters coupled to the outer periphery and defining a fixed blade cutter cutting profile having an outermost fixed blade cutter cutting diameter, each fixed blade cutter being coupled between adjacent rolling cutter mounts, and wherein at least a portion of the rolling cutter cutting profile is deeper than the fixed blade cutter cutting profile and wherein the outermost rolling cutter cutting diameter is larger than the outermost fixed blade cutter cutting diameter.

A hole opener having a hybrid reaming section for downhole earth boring operations may include a reamer body having a central longitudinal axis of rotation, an outer periphery, and upper and lower ends, a plurality of rolling cutter mounts coupled to the outer periphery about the longitudinal axis and depending downwardly, a rolling cutter rotatably coupled to each mount, the rolling cutters defining a rolling cutter cutting profile having an outermost rolling cutter cutting diameter, a plurality of fixed blade cutters coupled to the outer periphery and defining a fixed blade cutter cutting profile having an outermost fixed blade cutter cutting diameter, each fixed blade cutter being coupled between adjacent rolling cutter mounts, wherein at least one of the rolling cutters is coupled asymmetrically about the longitudinal axis, and wherein at least a portion of the rolling cutter cutting profile is deeper than the fixed blade cutter cutting profile and wherein the outermost rolling cutter cutting diameter is larger than the outermost fixed blade cutter cutting diameter.

DETAILED DESCRIPTION

Figure 1:
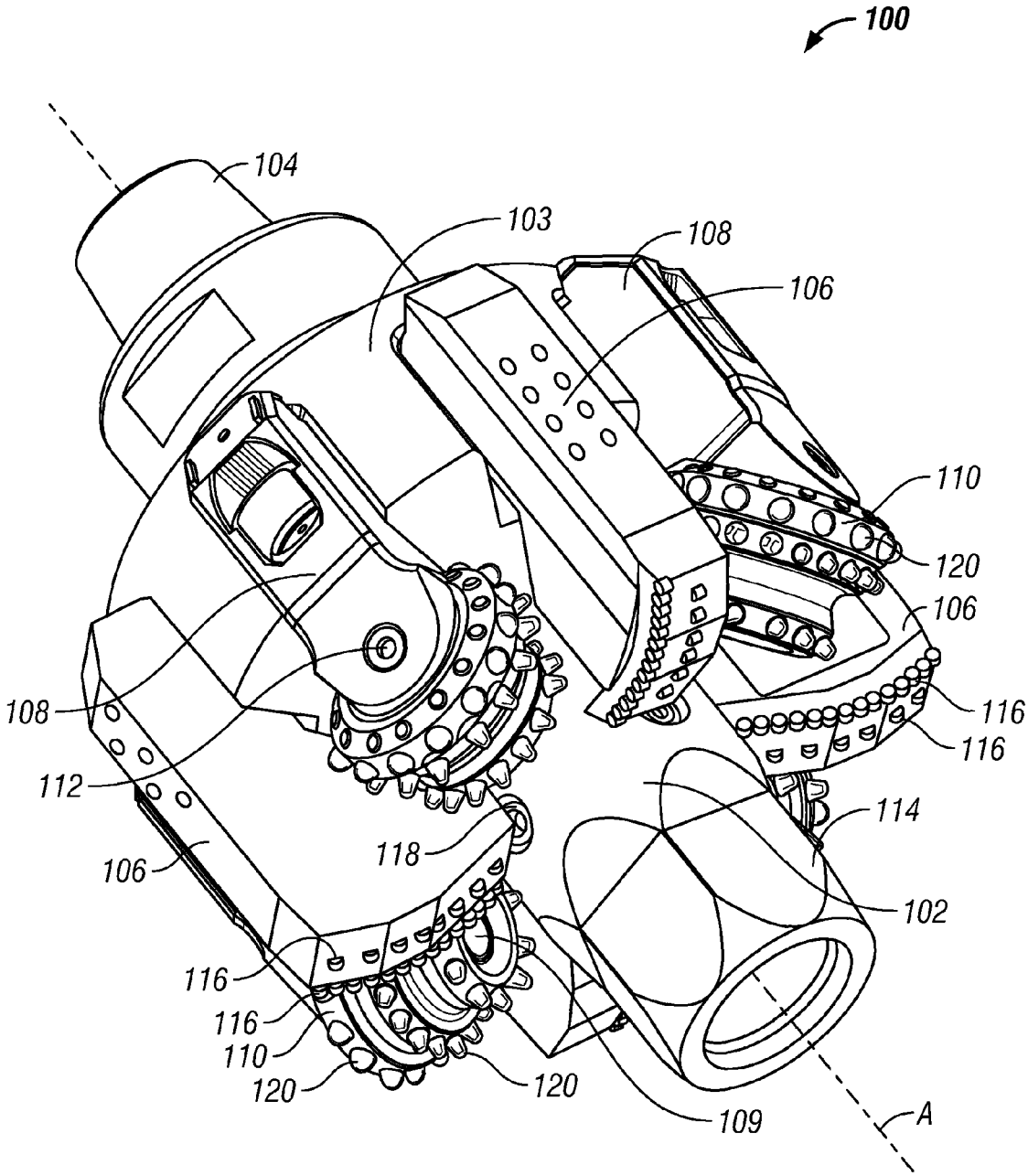
FIG. 1 illustrates one of many embodiments of a hybrid reamer having a fixed blade and a rolling cutter and utilizing certain aspects of the present invention.

The Figures described above and the written description of specific structures and functions below are not presented to limit the scope of what Applicants have invented or the scope of the appended claims. Rather, the Figures and written description are provided to teach any person skilled in the art to make and use the invention for which patent protection is sought. Those skilled in the art will appreciate that not all features of a commercial embodiment of the invention is described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in the art having the benefits of this disclosure. It must be understood that the invention disclosed and taught herein is susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together, removably or otherwise, and can further include without limitation integrally forming one functional member with another in a unity fashion. The coupling can occur in any direction, including rotationally.

Applicants have created a reamer tool assembly having a hybrid reaming section and methods of making and using the reamer. The hybrid hole opener, or hybrid reamer, may include a combination of rolling cutters and fixed blade cutters (or "fixed blades") coupled to a stem for supporting one or more components of the reamer. The term "rolling cutter" as used herein includes, but is not limited to, devices commonly referred to in the art as "roller cones." The reamer may comprise a reamer body, such as a generally cylindrically shaped body, having one or more rolling cutter mounts (e.g., a bit leg) coupled to its outer radial periphery. A rolling cutter may be coupled to each mount, wherein the rolling cutter may have cutting elements disposed in the downhole or lateral (gage) directions, for example, so that they may contact the formation to cut swaths or kerfs or grooves (hereinafter referred to as "path(s)") on the associated cutting surface while the reamer is rotating downhole. The rolling cutter cutting elements may hereinafter be referred to as "teeth," without limitation, and only for purposes of explanation in differentiating between rolling cutter cutting elements and other cutting elements. The reamer may further comprise one or more fixed blade cutters, or fixed blades, coupled to the body, wherein one or more of the fixed blades may be coupled adjacent one or more rolling cutter mounts. Each fixed blade may include cutting elements coupled thereto, each of which may, but need not, cut its own unique path in the cutting surface, in whole or in part. In at least one embodiment, which is but one of many, one or more fixed blade paths may be aligned or otherwise associated with one or more rolling cutter paths.

One or more of the many embodiments of the present invention will now be described in more detail with reference to the Figures.

Figure 2:
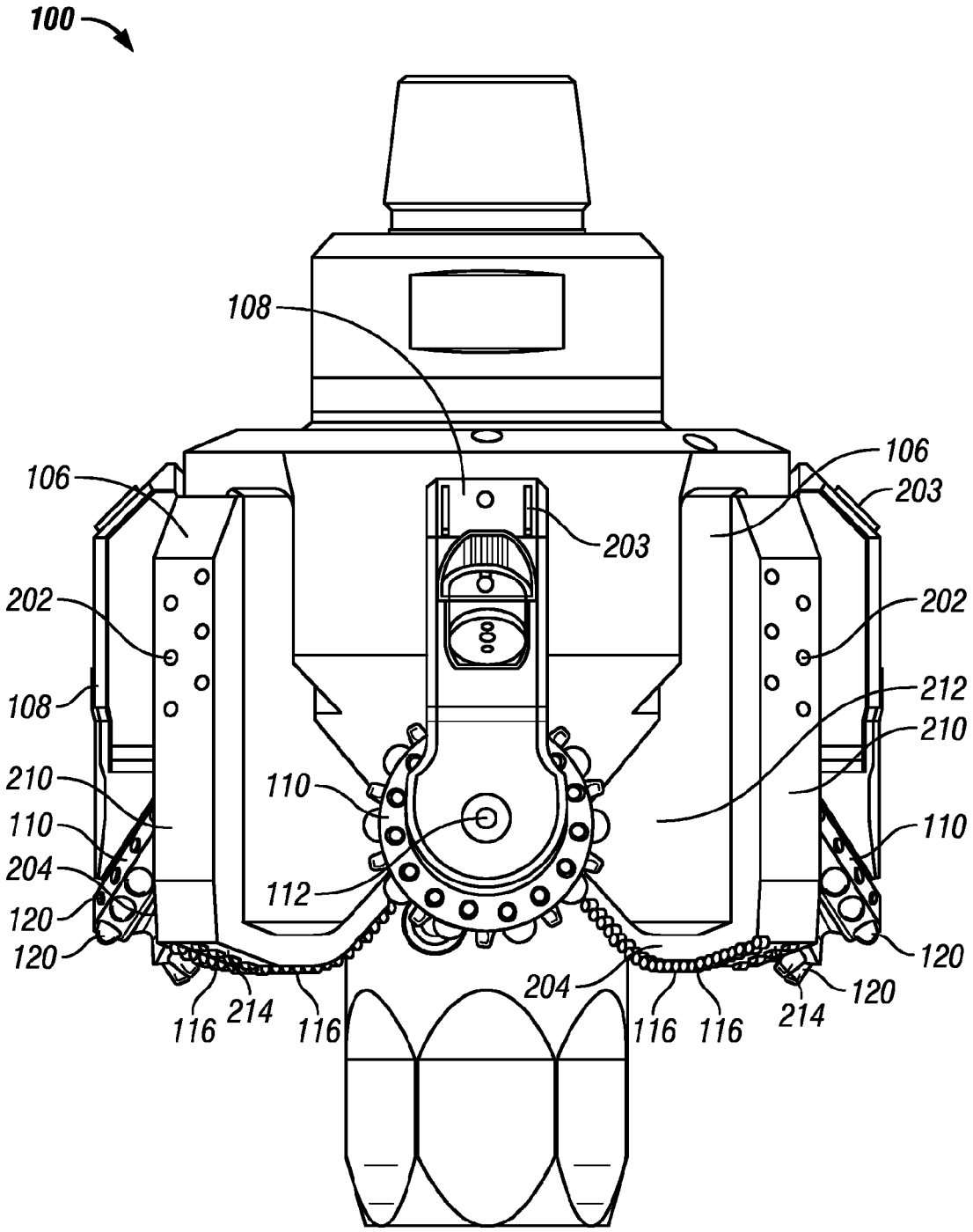
FIG. 2 illustrates another view of the hybrid reamer shown in FIG. 1.
Figure 3:
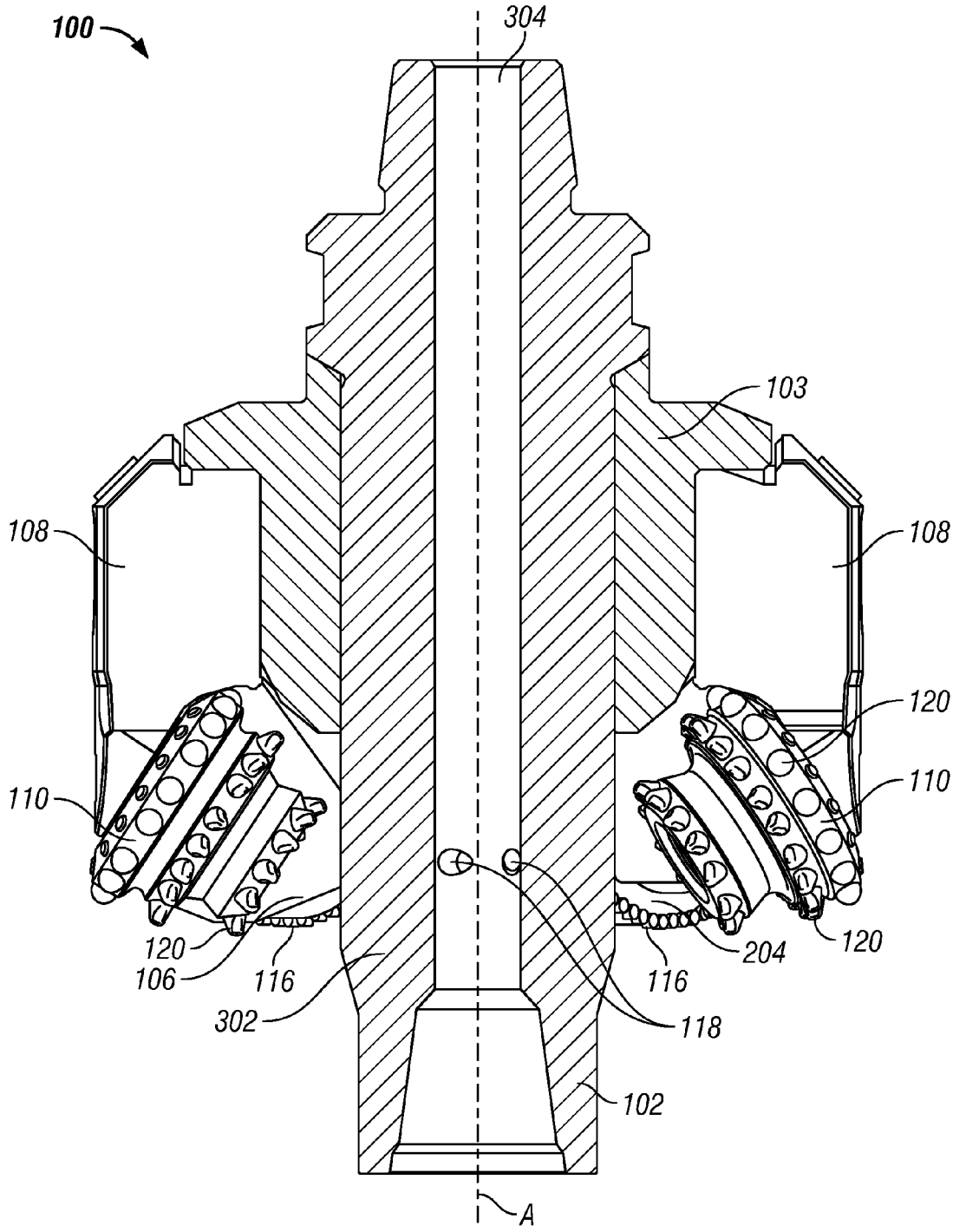
FIG. 3 illustrates a cross-sectional view of the hybrid reamer shown in FIGS. 1 and 2.

FIG. 1 illustrates one of many embodiments of a hybrid reamer 100 having a fixed blade and a rolling cutter and utilizing certain aspects of the present invention. FIG. 2 illustrates a side view of the hybrid reamer 100 of FIG. 1. FIG. 3 illustrates a cross-sectional view of the hybrid reamer of FIGS. 1 and 2. FIGS. 1-3 will be described in conjunction with one another. Reamer 100 may comprise a core for supporting reaming equipment. The core may include a stem 102 and a reamer body 103 and may, but need not, be generally cylindrical. Stem 102 may be at least partially tubular, such as to allow fluid to flow at least partially therethrough. Reamer 100 may include one or more cutting structures, such as a fixed blade 106 or rolling cutter mount 108, which may, but need not, be coupled to its outer radial periphery. Each mount 108 may include a roller shaft 109 generally angled toward a central longitudinal axis A of reamer 100. Cutters, such as rolling cutters 110, may be rotatably coupled on each roller shaft 109, directly or indirectly. In at least one exemplary embodiment, such as the embodiment of FIG. 1, four fixed blades 106 and four rolling cutters 110 may preferably be coupled radially around the periphery of body 103 in an alternating fashion, but they need not be. Alternatively, the various types of reaming components may be coupled in any order and in any number. While the fixed blades 106 and rolling cutters 110 of FIG. 1 are illustrated as having central radial axes that pass through axis A of reamer 100, they need not. For example, one or more rolling cutters 110 or fixed blades 106 may be "off-axis" as required by a particular application, such as, for example, where the component has one or more axes, such as a central axis, that does not pass through axis A (i.e. the axis of rotation) of reamer 100.

Each fixed blade 106 may include a plurality of cutting elements 116, which may, but need not, be tungsten carbide inserts, polycrystalline diamond compact ("PDC") cutting elements, or as another example, integrally formed cutting elements. Cutting elements 116 may be coupled anywhere on blade 106, such as on the downhole or bottomhole portion of blade 106 or, as another example, on the radially outermost or gage surface of blade 106, such as where cutting elements 202 are shown in FIG. 2. Each rolling cutter 110 may include one or more teeth 120 coupled thereto. Teeth 120 may be inserts, such as tungsten carbide inserts, steel teeth formed integrally with each rolling cutter 110, such as by milling, or any other type of teeth required by a particular application. Fixed blades 106 and rolling cutters 110 may define one or more cutting or reaming paths, separately or in combination, and may, but need not, be associated with one another. For example, one or more particular fixed blade cutting elements 116 may cut in the same path as a particular tooth 120 or row of rolling cutter teeth 120, or their paths may be adjacent, in whole or in part. For purposes of the disclosure herein, directly adjacent paths are paths that reside next to one another with no other path there between. Each rolling cutter 110 or fixed blade 106 may have a unique cutting profile defined at least partially by the cutting elements coupled thereto. In at least one embodiment, for example, at least a portion of the cutting profile of one or more fixed blades 106 may be curved or rounded and the cutting profile of one or more rolling cutters 110, such as an associated trailing rolling cutter 110, may match the curved cutting profile of the fixed blade 106, in whole or in part, as will be further described below. Alternatively, the fixed blade cutting profile may match the rolling cutter cutting profile, in whole or in part, or as another example, each cutting profile on reamer 100 may be unique. The term "match" as used herein means cutting in the same path during reaming, which may occur in whole or in part and between any two or more cutters or cutting elements. Reamer 100 may have any gage dimension, such as a diameter of, for example, 22-28 inches, as required by a particular application. The gage may be cut by any cutting profile or combination of cutting profiles, as required by a particular application and further described below.

As shown in FIG. 2, each blade 106 may include one or more cutting elements 116, 202 coupled to, for example, a portion of the blade 106 that may contact the wellbore, such as leading edge 204 or gage portion 210. One of ordinary skill in the art will understand that the placement of each cutting element 116, 202 may change from blade to blade, or as between embodiments of reamer 100. Each cutting element 116, 202 may or may not contact the wellbore in a particular application and if a particular cutting element 116, 202 contacts the wellbore, the cutting element may do so constantly or from time to time as reamer 100 spins downhole. Each blade 106, leading edge 204, or gage portion 210 may define any cutting profile required by a particular application, as will be further described below. A blade 106 may preferably form, in at least one embodiment, a smooth, rounded and durable profile, such as the exemplary profiles of each blade 106 shown in FIG. 2 and other FIGS. described herein. Fixed blade cutting elements 116, 202 may be brazed, welded or otherwise coupled to recesses or pockets on each blade 106, for example, so that the peripheral or cutting edge on each cutting face may be presented to the formation.

With further reference to FIGS. 2 and 3, each rolling cutter 110 may include one or more rolling cutter teeth 120. Each tooth 120 may be formed from any material and may be formed integrally with or coupled to rolling cutter 110 at any location required by a particular application. In at least one embodiment, rolling cutter mounts 108 may include updrill features, such as cutting elements or, as another example, hardfaced pads, coupled to their gage surfaces or on their upper portions, such as to updrill or ream in the uphole direction, as required by a particular application. A rolling cutter 110 may be mounted on a bearing 112 coupled to each support 108, such as sealed or unsealed journal bearings, roller-element bearings, or other bearings required by a particular application. Each bearing 112 may, but need not, be coupled to a roller shaft 109, which may be fixed, for example, so that rolling cutter 110 spins about shaft 109. The rotational axis of each rolling cutter 110 may, but need not, intersect the central longitudinal axis A of reamer 100. The radially outermost cutting portion of each rolling cutter 110, as well as that of each mount 108, may be "off gage" or spaced inwardly from the gage diameter of reamer 100, which may, but need not, be defined by fixed blades 106. In at least one alternative embodiment, the radially outermost or gage row of one or more rolling cutters 110 may define the gage diameter of the wellbore and the fixed blades 106 may be off gage, for example, which may protect the fixed blades 106 and associated cutting elements 116. In at least one other embodiment, the gage diameters defined by the fixed blades 106 and rolling cutters 110 may be equal, for example, so that the fixed blades 106 and rolling cutters 110 ream the gage diameter simultaneously. The lowermost or bottomhole cutting profiles and the gage cutting profiles of each fixed blade 106 or rolling cutter 110 may be formed independently or, alternatively, with reference to at least one associated cutting profile on reamer 100, as will be further described below. For example, the cutting profile of a particular fixed blade 106 may be associated with the cutting profile of a particular rolling cutter, which may, but need not, be an adjacent rolling cutter 110. At least one and preferably a plurality of teeth 120 may be coupled to each rolling cutter 110 in one or more generally circumferential rows. Each row may, but need not, create a unique path on the cutting surface coinciding with the row's particular disposition on a particular rolling cutter 110. Each individual row of teeth 120 on a rolling cutter 110 may cut a unique path having a radius different from the radii of paths cut by any other row of teeth on reamer 100. Alternatively, the paths of two or more rows may correspond as between rolling cutters in one or more embodiments, in whole or in part, as required by a particular application. The rolling cutter paths may be generally curvilinear and concentric with one another, but need not be. Teeth 120 may be arranged such that each tooth 120 is radially offset from axis A of reamer 100 (see FIG. 3). The offset distance may vary for each row of teeth 120 according to the application and reamer size, and may vary from rolling cutter to rolling cutter, and/or tooth to tooth. In at least one embodiment, for example, stem 102 may, but need not, be about 9 ¼ inches in diameter. In such an embodiment, for example, the innermost cutting diameter of reamer 100 may be, for example, about 12.25" about longitudinal axis A for a 22" reamer, 14.75" for a 24" reamer, 16" for a 26" reamer or, as another example, 17.75" for a 28" reamer. These examples are approximate and are used only for illustrative purposes. One of ordinary skill will understand that stem 102 may have any diameter and that any number of cutting elements or of rows of teeth may be located between stem 102 and the gage of reamer 100, at any distance from one another or from stem 102, as required by a particular application. Teeth 120 need not be arranged in rows, but instead may be "randomly" placed on each rolling cutter 110. Moreover, teeth 120 may take the form of one or more discs or "kerf-rings," which also fall within the meaning of the terms rolling cutter cutting elements or teeth as used herein. While teeth 120 are shown in FIGS. 1-3 to be inserts, such as tungsten carbide inserts coupled by interference fit into bores or apertures in rolling cutters 110, they need not be and may alternatively include teeth integrally formed with each rolling cutter 110, such as milled- or steel-teeth (see, e.g., FIG. 8A). Reamer 100 may include inserts and integral teeth separately, or in combination. The inserts or cutting elements may be chisel-shaped, as shown, conical, round, ovoid, or other shapes and combinations of shapes depending upon the application. Teeth 120 may, but need not, be hardfaced or, as other examples, formed of, or coated with, superabrasive or superhard materials such as polycrystalline diamond, cubic boron nitride, and the like.

Stem 102 may be tubular, such as to allow fluid to travel at least partially there through. Stem 102 may preferably be formed from high strength steel, but may be made from any material, such as a composite matrix or sintered carbide. Reamer 100 may include one or more couplers, such as coupler 104 or coupler 114, for coupling reamer 100 within a drill string, for example, which may include pipe, the bottom hole assembly ("BHA"), and/or other downhole equipment. Each coupler 104, 114 may be formed integrally with stem 102 or formed separately and coupled thereto, in whole or in part. In the exemplary embodiment of FIG. 1, which is but one of many, coupler 104 is shown to include a pin connection and coupler 114 is shown to include a box connection, such as American Petroleum Institute ("API") connections, on the uphole and downhole ends of stem 102, respectively. However, one of ordinary skill will understand that couplers 104, 114 may be any type of coupler required by a particular application. Reamer body 103 may be formed integrally with stem 102 or separately therefrom and coupled thereto, in whole or in part. Stem 102 may include one or more fluid orifices 118, for example, jets or ports, for allowing drilling fluid to flow to a desired location, such as from the interior to the exterior of stem 102. Reamer 100 may, but need not, include a pilot bit (see FIG. 10), such as for opening a hole to a first diameter, for example, a diameter less than the gage diameter of reamer 100. One of ordinary skill will understand that the pilot bit may be any type of bit required by a particular application, such as a hybrid bit, drag bit, rolling cutter bit, or other bit. The pilot bit may be coupled to the downhole end of reamer 100, such as to stem 102 or coupler 114, including being formed integrally therewith, in whole or in part. In at least one embodiment, such as the one shown in FIG. 1, which is but one of many, the pilot bit may be absent and coupler 114 may be used for any purpose required by a particular application, such as for coupling reamer 100 in a drill string or to another piece of downhole equipment, for example, to a plug or stabilizer.

Reamer 100 may include one or more junk slots 212, such as one between each side of adjacent reaming components, for allowing material, such as cuttings or fluid, to escape during reaming. For example, reamer 100 may include a junk slot between the trailing side of a rolling cutter 110 and the leading side of the fixed blade 106 that follows the cone 110 during reaming. Junk slots 212 will be further described below and may provide a generally unobstructed area or volume for clearance of cuttings and drilling fluid from the central portion of reamer 100 to its periphery, such as for return of these materials to the surface. The volume of one or more junk slots 212 may, but need not, exceed the open volume of other areas of the reamer, particularly in the angular dimension, such as between the trailing side of each blade 106 and the leading side of the following rolling cutter 110. The increased volume of junk slots 212 may be at least partially accomplished by providing a recess in the trailing side of each fixed blade 106, as will be further described below (see FIG. 4), for example, so that the rolling cutters 110 may be positioned closer to the trailing side of each fixed blade 106 than would be permitted without the clearance provided by the recess. Reamer 100 may include any number of junk slots 212 and may preferably include eight junk slots 212 in embodiments having four rolling cutters 110 and four fixed blades 106, such as the embodiment illustrated in FIGS. 1-3. The junk slots 212 may be in any location on reamer 100, as required by a particular application, such as between a rolling cutter 110 and a blade 106, a blade 106 and a rolling cutter 110, or elsewhere, singularly or in combination.

Reamer 100 may include one or more orifices 118 (see FIG. 3) for fluid passage, such as jets or nozzles, which may be circumferentially located about stem 102 for directing fluid to a desired location. For example, the orifices may be used for jetting cuttings, cleaning or cooling. One or more orifices 118 may be disposed in receptacles in stem 102, for example, for allowing fluid to pass from central fluid passageway 304 to the exterior of stem 102. Each orifice 118 may be coupled, for example, proximate to a junk slot 212, for removing formation material therefrom. In at least one embodiment, each orifice may be located and configured, for example, to direct a stream of fluid, such as drilling fluid, from the interior of stem 102 to a location proximate (and preferably forward of to avoid unnecessary wear on elements 116 and the material surrounding and retaining them) at least a portion of the leading edge 204 of each fixed blade 106 or the fixed blade cutting elements 116 coupled thereto. As another example, one or more orifices 118 may be located and configured to direct a stream of drilling fluid to a location at least proximate the trailing side of each rolling cutter 110 or rolling cutter teeth 120. The streams of drilling fluid may cool one or more portions of reamer 100 or, as another example, may remove cuttings from blades 106 or rolling cutters 110 and their respective cutting elements 116, 120. Orifices 118 may be, for example, conventional cylinders of tungsten carbide or similar hard metal and may have circular apertures of any selected dimension. Orifices 118 may be formed in any manner, such as integrally with wall 302 of stem 102, as modifications thereto or, as another example, they may be manufactured separately and otherwise coupled to reamer 100, in whole or in part.

With reference to FIG. 2, a plurality of backup cutting elements 214 may be coupled to each fixed blade 106, but need not be. For example, one or more backup cutting elements 214 may be coupled between the leading and trailing edges of each blade 106, such as, but not necessarily, in a row that may be generally parallel with or otherwise formed relative to leading edge 204 of blade 106. Backup cutting elements 214 may be similar in configuration to fixed blade cutting elements 116, but need not be, and may be any size. For example, backup cutting elements 214 may preferably be smaller in diameter and/or more recessed in one or more fixed blades 106, such as to provide a reduced exposure to the formation as compared to the primary fixed blade cutting elements 116 on the leading edge 204. In at least one embodiment of reamer 100, backup cutting elements 214 may comprise BRUTE™ cutting elements, as offered by the assignee of the present invention through its Hughes Christensen operating unit, such cutters and their use being disclosed in U.S. Pat. No. 6,408,958, which is herein incorporated by reference for all purposes. As another exemplary alternative, rather than being active cutting elements similar to fixed blade cutting elements 116, backup cutting elements 214 may be passive elements, such as round or ovoid tungsten carbide or superabrasive elements, which may, but need not, lack edges (although still referred to as backup cutters or cutting elements). Such passive elements may serve, for example, to protect the lower surface of each blade 106 from wear. In at least one embodiment, which is but one of many, backup cutting elements 214 may preferably be radially spaced along each blade 106 to concentrate their effects in the apex, shoulder, and gage sections (as described further below). Backup cutting elements 214 may, but need not, be arranged on blades 106 to match the fixed blade cutting elements 116, for example, so that backup cutting elements 214 cut in the same path made by the primary cutting elements 116, in whole or in part. Alternatively, backup cutting elements 214 may be arranged to be radially offset from the fixed blade cutting elements 116 on one or more blades 106, so that they cut between the paths made by cutting elements 116. Backup cutting elements 214 may add cutting elements to the cutting profile and increase cutter "coverage" in terms of redundancy at each radial position (relative to the axial center of the wellbore or axis A of reamer 100) or path on the bottom of the borehole. Whether active or passive, backup cutting elements 214 may help reduce wear of and damage to cutting elements 116, and may help reduce the potential for damage to or wear of fixed blades 106. Backup cutting elements 214 may, but need not, create additional points of engagement between reamer 100 and the formation being reamed, which may enhance reamer stability, for example.

Reamer 100 may include a plurality of wear-resistant gage elements, such as cutting elements 202, coupled to the gage surface. For example, one or more gage elements 202 may be coupled to the outermost periphery of each blade 106 or mount 108. Each element 202 may be, for example, a flat-topped or round-topped tungsten-carbide or other hard-metal insert coupled to apertures, for example, by interference fit. Alternatively, or additionally, the inserts 202 may be integrally formed on the gage or one or more wear pads 203 may be coupled to the gage surface of reamer 100. Each element 202 or wear pad may, but need not, be hardfaced. The primary function of elements 202 may be passive, such as to resist wear of blades 106 or mounts 108. Alternatively, it may be desirable to place active cutting elements on the gage of one or more blades 106, such as super-hard (e.g., polycrystalline diamond) flat-topped elements or other elements having, for example, beveled edges for shearing or cutting the sidewall of the borehole being reamed. Wear-resistant elements or pads may be coupled to the gage of one or more blades 106, supports 108 or elsewhere on reamer 100, separately or in combination.

Each component of reamer 100 may be formed from any material required by a particular application, such as a metal, alloy, composite or another material, separately or in combination. For example, stem 102 may preferably be formed from high strength steel, such as 4145H or another steel, and body 103 may preferably be formed from 1018 steel, for example. The materials used to form these components, and others, may depend on any number of factors required by a particular application, such as strength, availability, costs, or other factors, as will be understood by one of ordinary skill in the art. Each component of reamer 100, such as those described above, may be coupled to stem 102 permanently, removably, or otherwise. For example, fixed blades 106 and rolling cutter mounts 108 may be permanently welded to stem 102, or they may be removable, such as using pins, screws, bolts, or the like. The components may be replaceable, interchangeable, or reusable and may be coupled to stem 102 in any order, such as, for example, in an alternating fashion. Reamer 100 may include other components useful for reaming a wellbore, wherein reaming may occur in any direction, including uphole, downhole or laterally.

Figure 4:
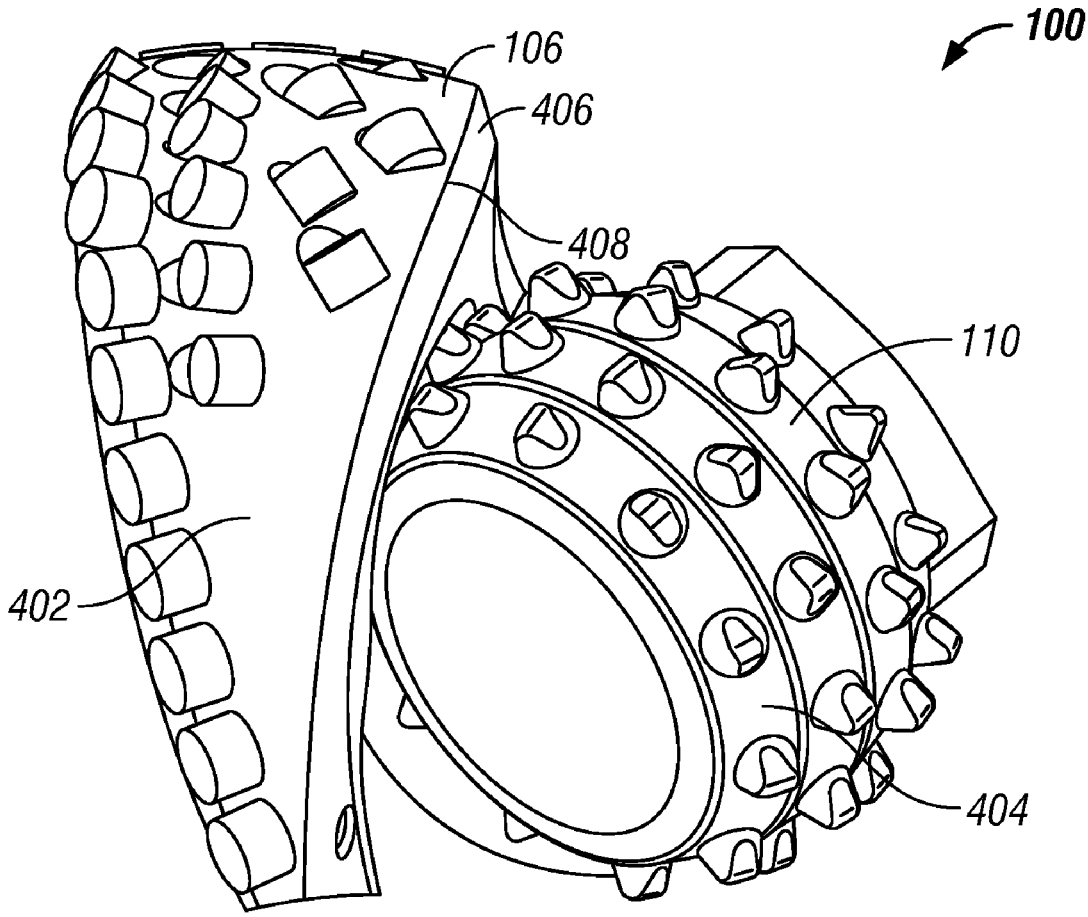
FIG. 4 illustrates one of many embodiments of a hybrid reamer having a contoured fixed blade and a rolling cutter and utilizing certain aspects of the present invention.

FIG. 4 illustrates one of many embodiments of a hybrid reamer 100 having a contoured fixed blade 106 and an associated rolling cutter 110 and utilizing certain aspects of the present invention. The bottom surface 402 of a particular blade 106 may, but need not, be in, or substantially in, the same plane as the bottom surface 404 of an associated rolling cutter 110, which may, but need not, be an adjacent rolling cutter 110. In at least one exemplary embodiment, the sides of blade 106, such as trailing side 406, may, but need not, be contoured. For example, trailing side 406, or a portion thereof, may be any shape required by a particular application, such as concave or cupped, which may allow at least a portion of rolling cutter 110 to be disposed in front of at least a portion of trailing edge 408 of fixed blade 106. In such an embodiment, for example, the angular distance about the central axis of reamer 100 between leading fixed blade 106 and trailing rolling cutter 110 may, but need not, be less than the angular distance between the rolling cutter 110 and the cutter that follows (not shown) rolling cutter 110 during reaming. This may allow, for example, a greater volume of space to exist on the trailing side of rolling cutter 110, which may be desirable in one or more particular applications, such as to provide a junk slot for allowing formation material or fluid to escape during reaming. The leading side or face of blade 106 may have the same or a different shape than the trailing side, in whole or in part.

Figure 5:
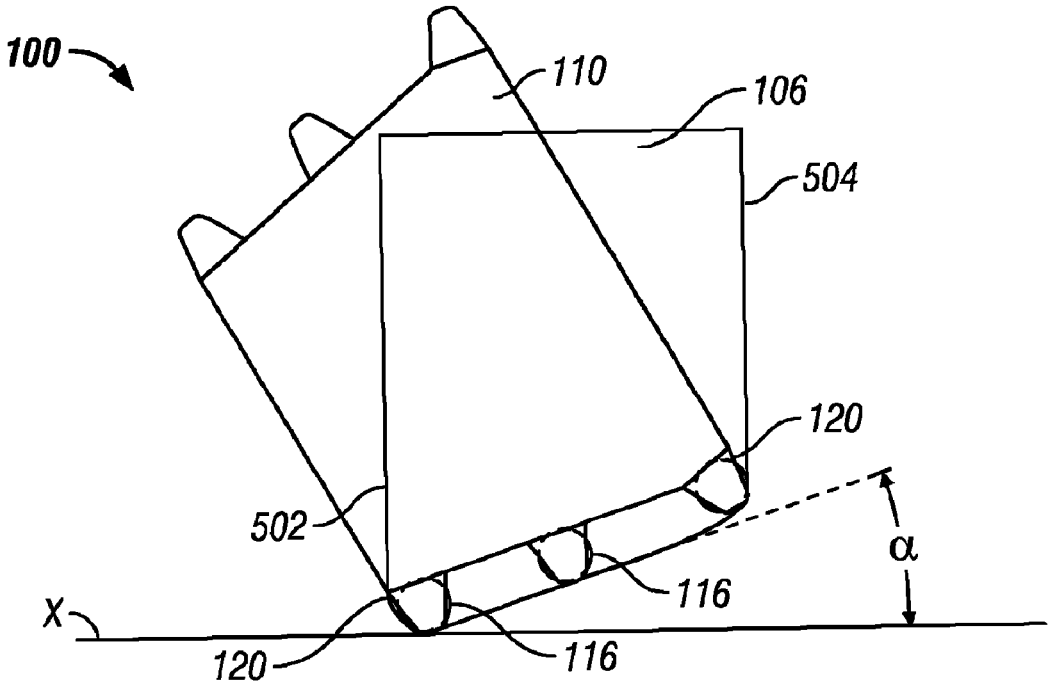
FIG. 5 illustrates one of many cutting profiles of a rolling cutter and an associated fixed blade utilizing certain aspects of the present invention.
Figure 6:
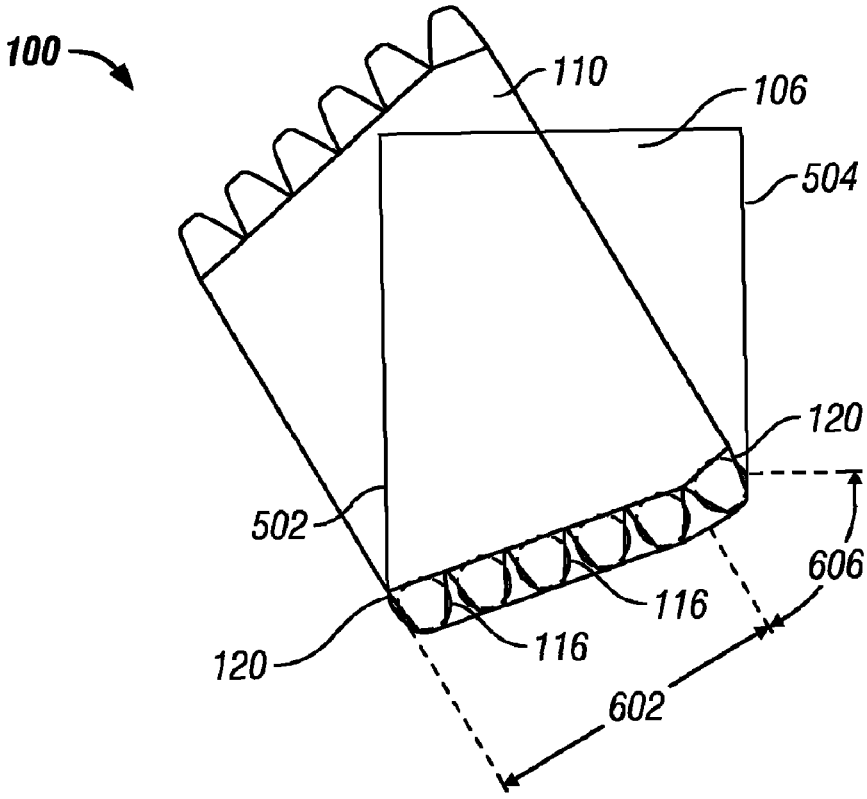
FIG. 6 illustrates one of many cutting profiles of a plurality of rolling cutters and fixed blades utilizing certain aspects of the present invention.
Figure 7:
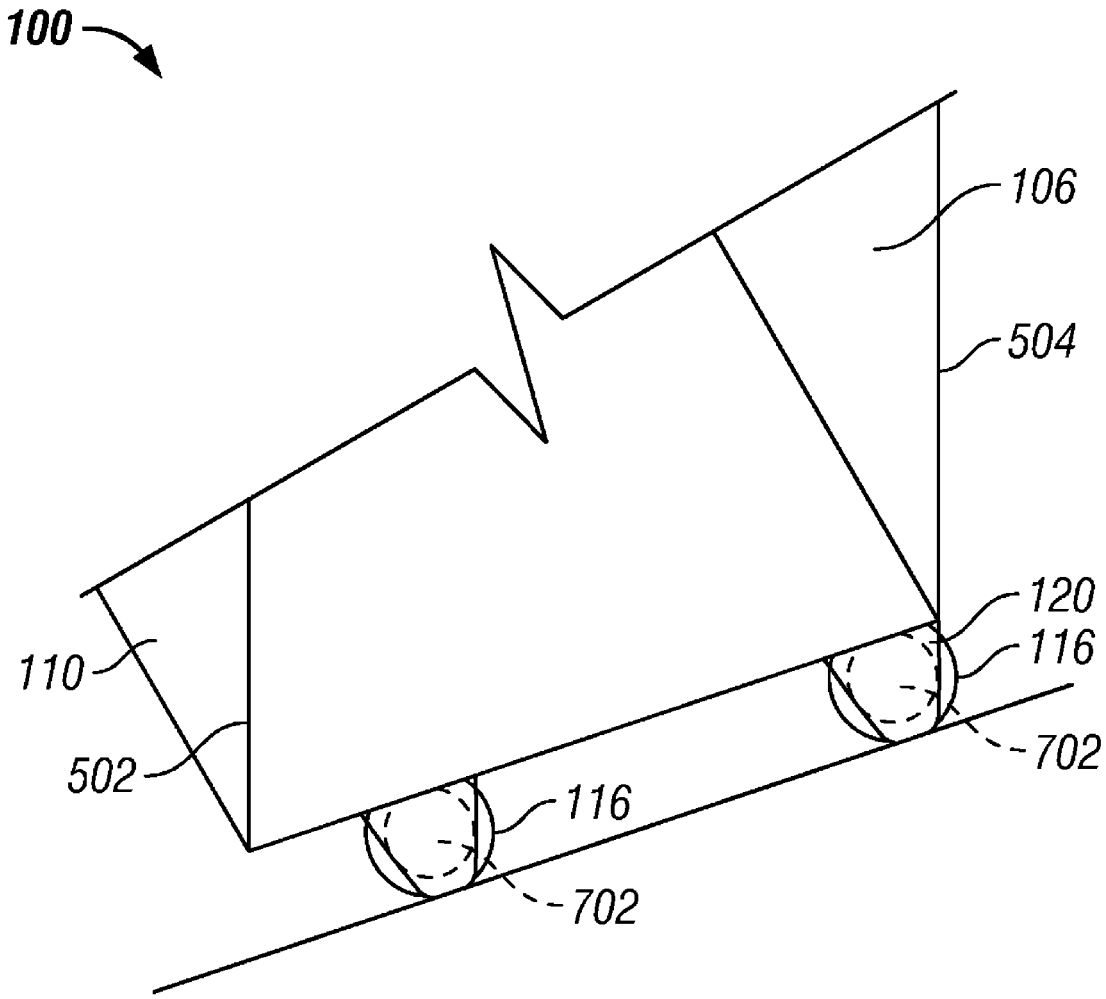
FIG. 7 illustrates one of many cutting profiles of a hybrid reamer having backup cutting elements and utilizing certain aspects of the present invention.

FIG. 5 illustrates one of many cutting profiles of a rolling cutter 110 and an associated fixed blade 106 utilizing certain aspects of the present invention. FIG. 6 illustrates one of many cutting profiles of a plurality of rolling cutters 110 and fixed blades 106 utilizing certain aspects of the present invention. FIG. 7 illustrates one of many cutting profiles of hybrid reamer 100 having backup cutting elements 760 and utilizing certain aspects of the present invention. FIGS. 5-7 will be described in conjunction with one another. The shape of a particular rolling cutter 110 or fixed blade 106, in conjunction with other features, such as the arrangement of cutting elements thereon, defines the shape or profile that particular reaming component makes in the formation. A cutting profile is a schematic representation of the shape a particular cutter, or plurality of cutters, makes in a formation during reaming. FIG. 5 illustrates a cutting profile formed by combining the cutting profiles of a single fixed blade 106 and its associated rolling cutter 110 in a single radial plane through the central longitudinal axis of reamer 100. FIG. 6 illustrates a cutting profile formed by combining the cutting profiles of each of a plurality of fixed blades 106 and rolling cutters 110 on one of many embodiments of reamer 100 in a single radial plane through the central longitudinal axis of reamer 100, thereby illustrating one of many overall reamer cutting profiles in accordance with the present invention. A combined reamer cutting profile may be at least partially defined by the relationship between fixed blade cutting elements 116 and the teeth 120 of an associated roiling cutter 110. In a particular cutting profile, the profile of teeth 120 of a rolling cutter 110 may, but need not, match, in whole or in part, the profile of cutting elements 116 on an associated blade 106. In at least one embodiment, for example as shown in FIG. 5, the cutting profile of one rolling cutter 110 may overlap or match at least a portion of the cutting profile of an associated blade 106, which may be any blade 106. The cutting profiles of an associated pair of cutters need not match, however, and one or more cutters may have an entirely unique cutting profile. Each cutting element 116, 120 may be centered or offset within their respective paths and may have any depth of cut required by a particular application. The axially lowest (i.e., furthest downhole) points on the cutting profile of a particular fixed blade 106 or rolling cutter 110 may be planar with or lower than the lowest points on the profile of an associated cutter on a particular reamer 100, as required by a particular application, and as further described below. In at least one embodiment, which is but one of many, the lowest points on the profile of a particular blade 106 may advantageously be higher than the apex of a particular rolling cutter 110, such as an associated rolling cutter 110. Similarly, any of elements 116, 120 may be axially spaced apart, such as, for example, by as much as 0.125 inch or more, when in their distal most (i.e. lowest) positions. In at least one embodiment, for example, rolling cutter teeth 120 may extend beyond (e.g., by approximately 0.060-0.125 inch) the distal most position of the fixed blades 106 and fixed blade cutting elements 116, in whole or in part. The cutting structure of reamer 100 as a whole, including one or more cutting profiles, may be varied by adjusting the position of each rolling cutter 110 and blade 106, or portions thereof, relative to the reamer longitudinal axis, or to one another, and may be varied according to any factor required by a particular application, such as, for example, costs, materials, wellbore or formation characteristics, depth of cut (DOC) or weight on bit (WOB) considerations, efficiency, or other factors, such as aggressiveness.

As shown in FIGS. 5 and 6, the rolling cutter teeth 120 and the fixed blade cutting elements 116 in combination may define a cutting profile that extends from the radially innermost reaming portion 502 of reamer 100, which may, but need not, be an outer surface of stem 102 (see, e.g., FIG. 1), through a cone section 602 and a shoulder section 606, to a radially outermost, or gage, portion 504. Cone section 602 may include cutting elements that extend radially inwardly to stem 102 of reamer 100, but need not, and may alternatively include an innermost cutting element that is radially spaced apart from an outer surface of stem 102, such as being in line with a pilot hole. The axially lowermost edge along the cutting profile may be referred to as a contour, or profile, line. As shown in FIG. 5, for example, the cutting elements 116, 120 of an associated pair of cutters 106, 110 in combination cut three congruent, or substantially congruent, paths in the formation. One or more other cutters 106, 110 or pairs of cutters may cut additional paths in the formation, such as between the paths cut by the pair of cutters shown in FIG. 5, which may thereby define the reamer cutting profile for a particular embodiment of reamer 100, for example, as shown in FIG. 6. One or more cutting elements may be disposed in the apex of the cutting plane of reamer 100, represented in FIG. 5 by plane X. The apex of a particular cutting profile of reamer 100 may include one or more fixed blade cutting elements 116, one or more teeth 120, or both. The profiles of a particular fixed blade 106 and the associated rolling cutter 110 may, but need not, be aligned at the gage 504, for example, so that both cutters cut on gage during reaming. Alternatively, for example, either the fixed blade profile or the rolling cutter profile may alone extend to the gage of reamer 100. Cone section 602 may form an angle $\alpha$ with the horizontal, which may be any angle, such as an angle between about 0 and 45 degrees, and which may preferably be between about 10 and 30 degrees. Shoulder section 606 may have a single radius or a compound radius, and the combined cutting profile of reamer 100 may, but need not, be tangent to gage portion 504 of reamer 100. The combined cutting profile may be linear or curved, and may, but need not, include multiple compound radii. The apex of a reamer cutting profile may be particularly highly loaded when reaming through transitions, for example, from soft to hard rock, such as when the entire reamer load can be concentrated on this relatively small portion of the borehole. The shoulder section 606, on the other hand, may have to absorb high lateral forces, which can be caused by dynamic dysfunctioning such as bit whirl or stick-slip. With reference to FIG. 7, one or more fixed blades 106 may include one or more backup cutting elements 702 coupled behind cutting elements 116. Each backup cutting element 702 may, but need not, cut in the same path as a leading fixed blade cutting element 116, or an associated rolling cutter tooth 120, in whole or in part. Within a particular path, each backup cutting element 702 may be located either on or off the center of a cutting element 116 located in front of the backup cutting element 702 associated therewith. Each backup cutting element 702 may have the same or less exposure of cut as one or more cutting elements 116, 120 and may have the same or a smaller diameter than a cutting element 116. As will be understood by one of ordinary skill in the art having the benefits of this disclosure, the orientations of cutting elements 116, 120, 702 and their cutting profiles may be infinite and may arranged in any manner required by a particular application.

Turning now to another aspect of the present invention, the aggressiveness of reamer 100 will now be described. The aggressiveness may, but need not, be defined as a function of penetration rate of the reamer during reaming to weight on bit during reaming, and may be adjusted in at least one way, as further described below. Adjusting the angular spacing between each rolling cutter 110 and fixed blade 106 may be one way in which to adjust the cutting aggressiveness, or aggressiveness, of reamer 100. The closer a rolling cutter 110 is to a fixed blade 106 in the angular dimension about the central axis of reamer 100, the more so the rolling cutter 110 may act as the primary cutter of the pair, with the fixed blade 106 cutting the lesser of the pair. That is, spacing a rolling cutter 110 closer to a fixed blade 106 of a pair of cutters on reamer 100 may cause rolling cutter 110 to have the more dominate (or "driving") cutting action of the pair of cutters, thereby causing reamer 100 to cut relatively less aggressively. On the other hand, for example, spacing a rolling cutter 110 further away from a fixed blade 106 of a pair of cutters on reamer 100 may, but need not, allow or cause the cutting elements of the fixed blade 106 to dominate the cutting action of the pair of cutters, which may increase the overall cutting aggressiveness or aggressiveness of reamer 100. Another way of altering the cutting aggressiveness of reamer 100 may include adjusting the axial position of each reaming component, including each rolling cutter, fixed blade, and/or their respective cutting elements. An axially "leading" structure is one which contacts the cutting surface before an associated axially "trailing" cutting structure. Any type or number of cutting elements on reamer 100 may axially lead or trail any other type or number of cutting elements thereon, in whole or in part, as required by a particular application. For example, a rolling cutter 110 may lead a trailing fixed blade 106 of an associated pair of cutters (the pair including one of each type of cutter) or, as another example, a fixed blade 106 may lead a trailing rolling cutter 110 of an associated pair of cutters. Generally, the more a fixed blade 106 leads a rolling cutter 110 of a pair of cutters of hybrid reamer 100, the more aggressively reamer 100 may cut, which may include cutting more like a fixed blade bit or reamer, such as a polycrystalline diamond (PDC) bit or reamer. On the other hand, when a rolling cutter 110 leads a fixed blade 106 of a pair of cutters of hybrid reamer 100, the aggressiveness may decrease, which may include the hybrid reamer 100 having aggressiveness more akin to that of a pure rolling cutter (e.g., roller cone) bit or reamer. Therefore, the axial positions of one or more cutting structures of a particular embodiment of reamer 100 may be adjusted relative to the cutting surface, or to one another, to meet the aggressiveness requirements of a particular application, as will be understood by one of ordinary skill in the art having the benefits of this disclosure.

Figure 8A:
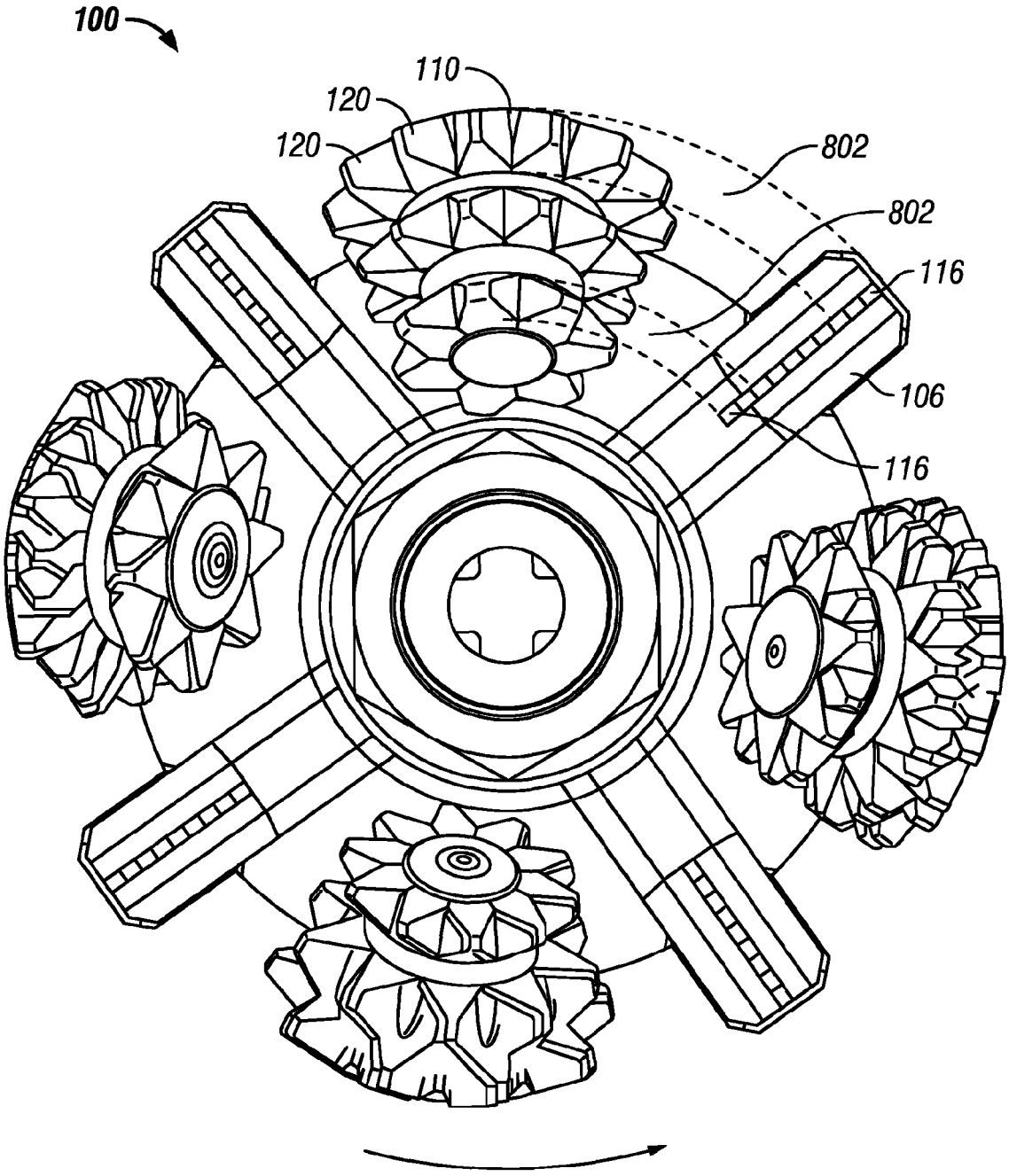
FIGS. 8A, 8B and 8C illustrate one of many different embodiments of a hybrid reamer having a rolling cutter cutting the gage and utilizing certain aspects of the present invention.
Figure 8B:
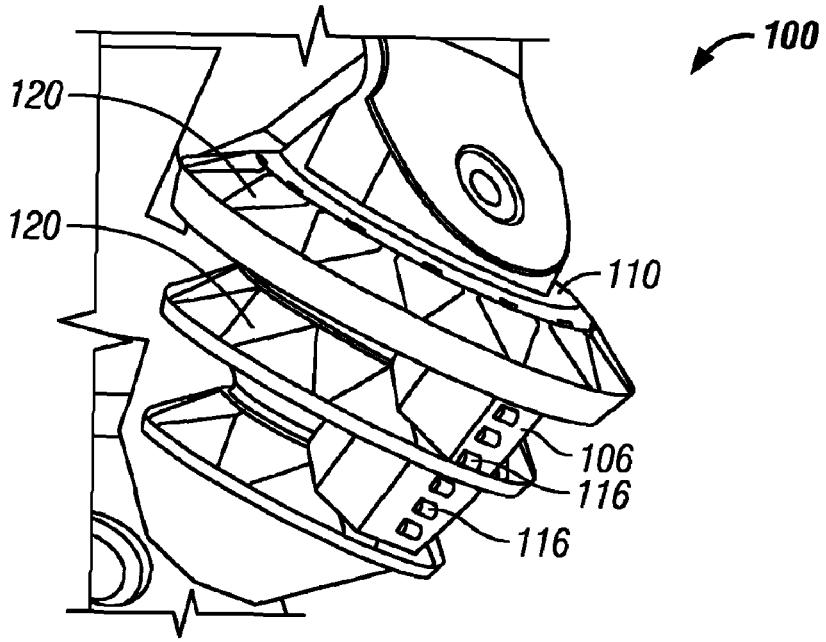
Figure 8C:
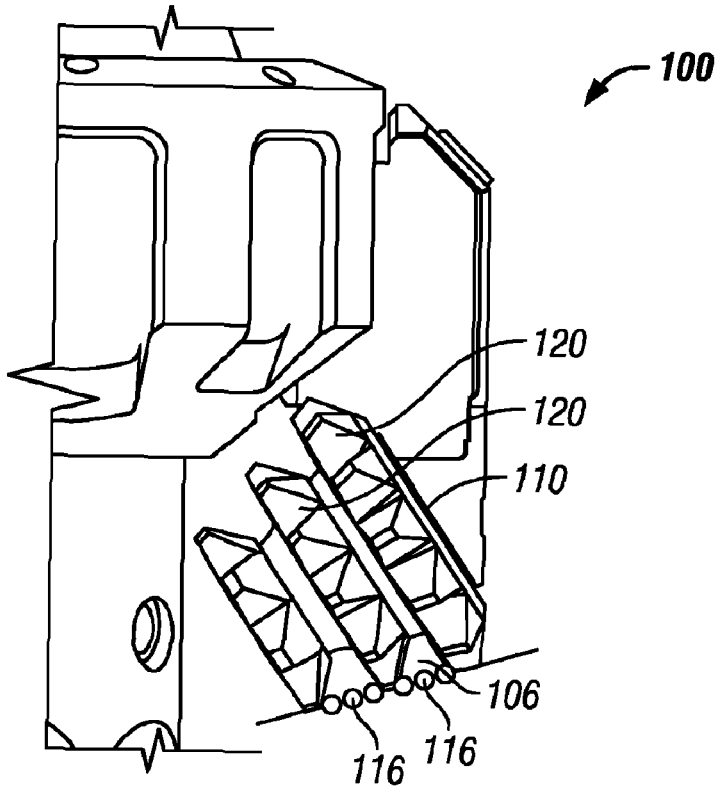
Figure 8D:
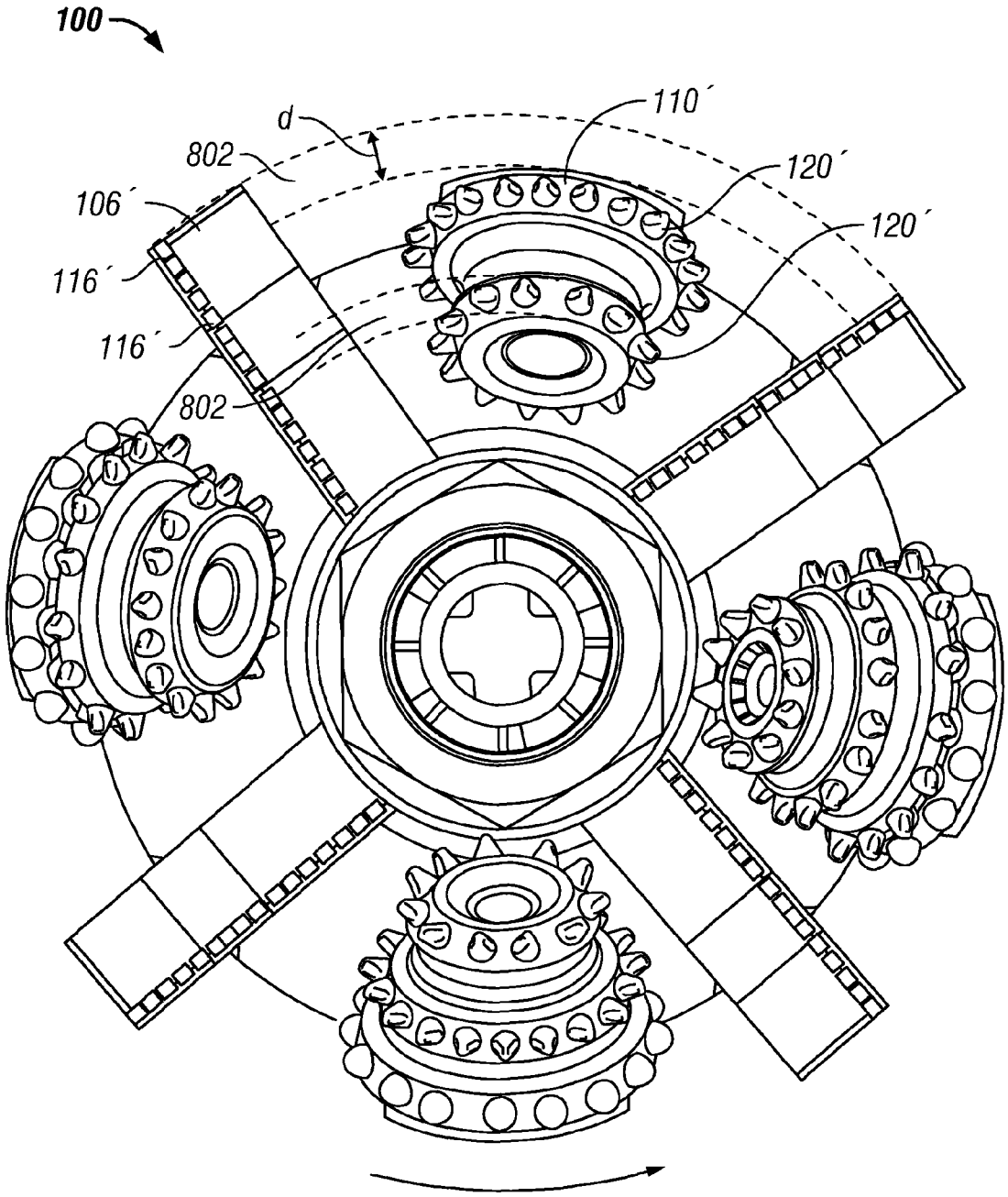
FIGS. 8D, 8E and 8F illustrate one of many different embodiments of a hybrid reamer having a fixed blade cutting the gage and utilizing certain aspects of the present invention.
Figure 8E:
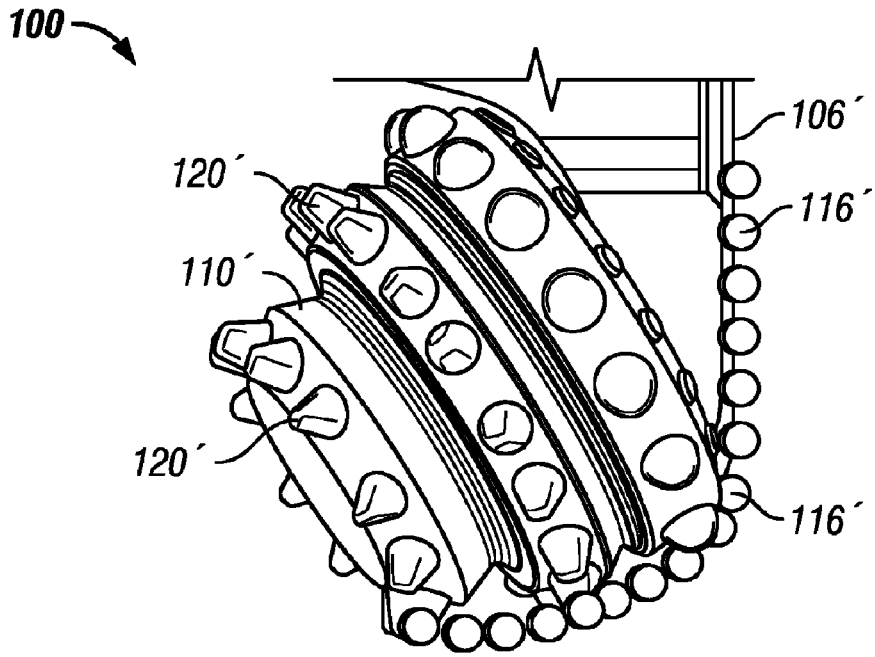
Figure 8F:
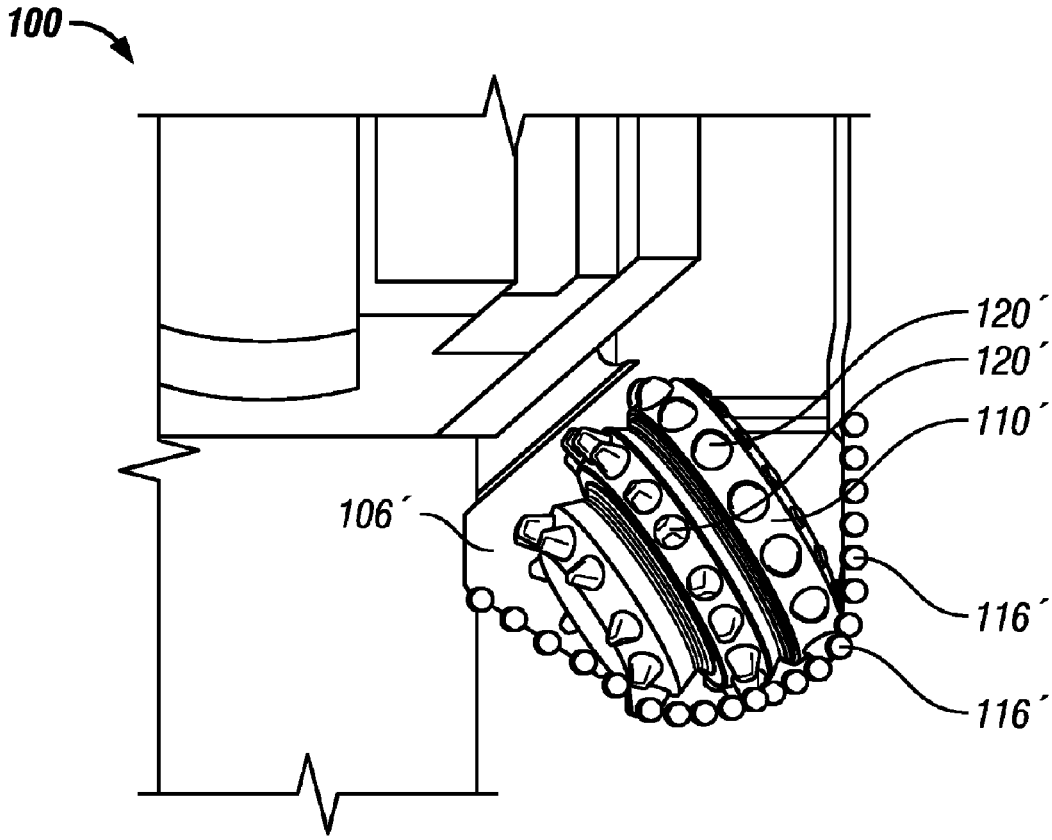
Figure 8G:
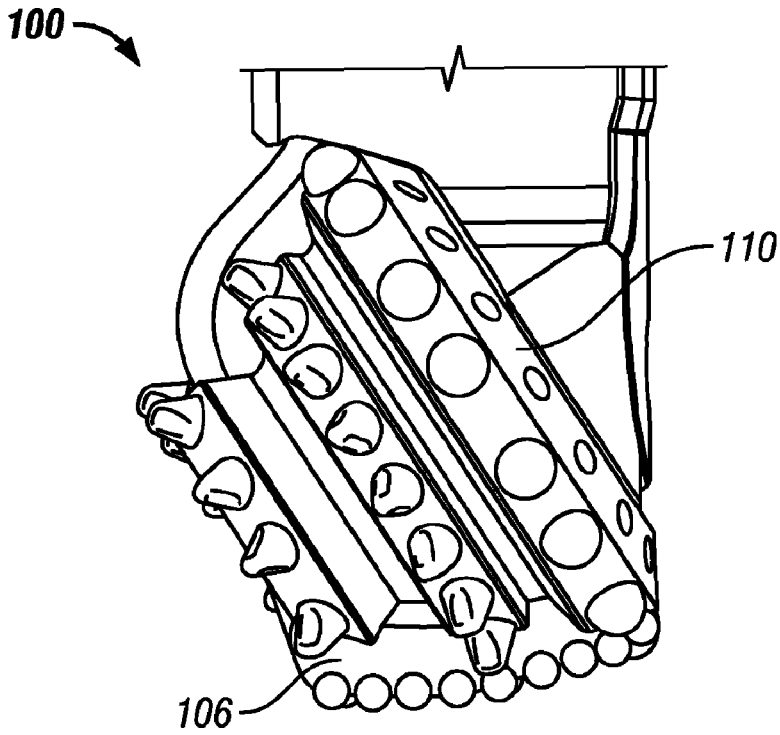
FIGS. 8G and 8H illustrate one of many different embodiments of a hybrid reamer having a fixed blade and a rolling cutter cutting the gage and utilizing certain aspects of the present invention.
Figure 8H:
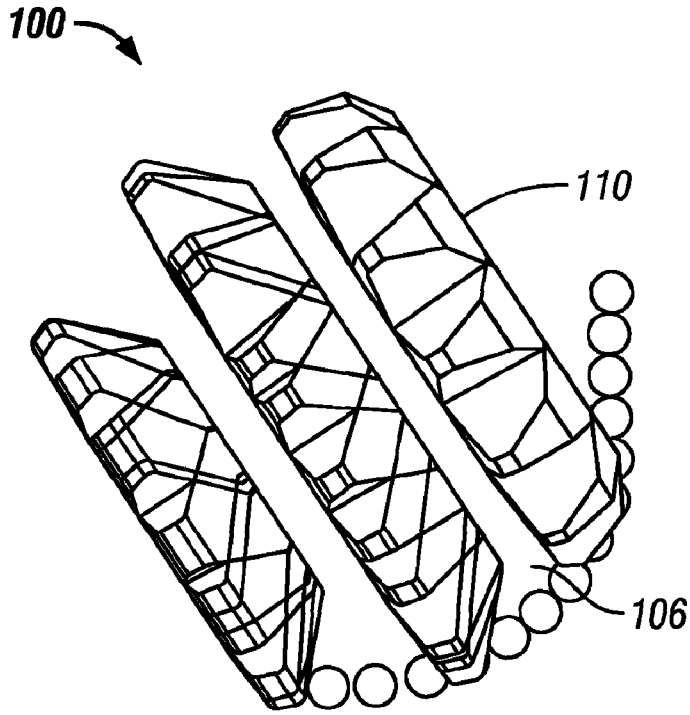

FIGS. 8A, 8B and 8C illustrate one of many different embodiments of reamer 100 having a rolling cutter 110 cutting the gage and utilizing certain aspects of the present invention. FIGS. 8D, 8E and 8F illustrate one of many different embodiments of reamer 100 having a fixed blade 106' cutting the gage and utilizing certain aspects of the present invention. FIGS. 8G and 8H illustrate one of many different embodiments of reamer 100 having a fixed blade 106 and a rolling cutter 110 cutting the gage and utilizing certain aspects of the present invention. FIGS. 8A-8G will be described in conjunction with one another, wherein paths 802 are indicated by phantom lines in FIGS. 8A and 8D. Within a particular path 802 cut into a new portion of formation, a first portion may be removed by one or more leading cutting elements and a remaining portion within that path 802 may be removed by one or more trailing cutting elements. The leading and trailing cutting elements may be rolling cutter teeth or fixed blade cutting elements, which may, but need not, be coupled to an adjacent pair of cutters, as required by a particular application. The leading cutting elements may, but need not, be the driving cutting elements, or those elements that dominate the cutting characteristics of reamer 100 as a whole. In at least one embodiment, for example, at least one trailing cutting element 116 on fixed blade 106 may cut in the same path 802 (see FIG. 8A), in whole or in part, as one or more of the leading teeth 120 on rolling cutter 110. Similarly, at least a portion of one of the trailing teeth 120' on rolling cutter 110' may cut in the same path 802 (see FIG. 8D) as one or more leading cutting elements 116' on fixed blade 106'. Generally, when a reamer 100 is rolling cutter driven, such as where a rolling cutter leads a trailing fixed blade cutter, cutting aggressiveness or aggressiveness of hybrid reamer 100 may be decreased. Conversely, when a fixed blade cutter drives the reamer 100, such as where a fixed blade leads a trailing rolling cutter, the cutting aggressiveness, or aggressiveness, of hybrid reamer 100 may be increased. Alternatively, with reference to FIGS. 8G and 8H, the separate cutting profiles of each cutter of an associated pair of cutters, such as one fixed blade 106 and one rolling cutter 110, may match, in whole or in part. For example, one or more fixed blade cutting elements 116 on a particular fixed blade 106 match the tooth 120 or row of teeth 120 on the particular rolling cutter 110 that is associated with the fixed blade 106 if the cutting element(s) 116 and tooth (teeth) 120 cut in the same path during reaming. Matching cutting elements may, but need not, be present and may, but need not, be disposed on adjacent cutters.

As mentioned previously herein, any type of cutter (rolling or fixed blade) may cut the gage of the borehole (i.e., may define the gage diameter of reamer 100). With further reference to FIGS. 8A-8G, a plurality of exemplary embodiments of reamer 100 having different gage cutting structures are described. In at least one embodiment of reamer 100, such as the one shown in FIGS. 8A-8C, only the rolling cutters 110 may cut the gage of the borehole, and the fixed blades 106 may be off gage. In at least one other embodiment of reamer 100, such as the one shown in FIGS. 8D-8F, only the fixed blades 106' may cut the gage of the borehole, and the rolling cutters 110' may be off gage. In at least one other embodiment of reamer 100, such as the one shown in FIGS. 8G-8H, the rolling cutters 110 and fixed blades 106 may cut the gage simultaneously. The off-gage distance, for example, distance d in FIG. 8D, may be any distance required by a particular application and may be defined by the position, size or shape of any particular cutter(s) or cutting element(s). The gage section of the cutting profile of a particular embodiment of reamer 100 may, but need not, be formed independently from the remaining sections of the profile, as will be understood by one of ordinary skill having the benefits of the present disclosure.

In at least one embodiment, such as where there are an equal number of fixed blades 106 and rolling cutters 110, each fixed blade 106 may be associated with a rolling cutter 110, for example, which may include cutting elements on the paired cutters cutting in the same paths 802, or matching, when reaming a formation. Any two cutters may be associated as required by a particular application, notwithstanding their position on the reamer tool. Generally speaking, for example, all rolling cutters may lead all fixed blade cutters, making a relatively less aggressive bit or, as another example, all fixed blade cutters may lead all rolling cutters, making a relatively more aggressive bit. At least one embodiment of reamer 100 may have three rolling cutters and three fixed blades, wherein one or more of the cutting elements of a particular rolling cutter may cut in the same path as one or more of the cutting elements on an associated fixed blade, wherein the associated rolling cutter and fixed blade oppose one another about the central axis of reamer 100. As other examples, at least one embodiment may include one or more sets of cutting elements that match, in whole or in part, and one or more sets of cutting elements that do not match. A particular embodiment of reamer 100 may include any or all of the above, in any combination, as required by a particular application. For example, in softer formations (such as soft and medium hard), it is believed that the more aggressive "fixed blade leading" hybrid reamer configurations may result in the best penetration rate. In any event, according to the preferred embodiment of the present invention, the aggressiveness of a particular embodiment of reamer 100 may be tailored or varied to the particular reaming and formation conditions encountered using the teachings herein.

With further reference to FIGS. 8A-8C, still another way to adjust or vary the aggressiveness of hybrid reamer 100 may be to couple the cutting elements 120 on the rolling cutters 110 so that they project deeper into the formation being reamed than the cutting elements 116 on fixed blades 106. One way to do this may be to adjust the projection of some or all of the cutting elements 120 on the rolling cutters 110 from the surface of each rolling cutter 110 so that they project in the axial direction (parallel to the central axis of reamer 100) further than some or all of the cutting elements 116 on fixed blades 106. In theory, the extra axial projection of the teeth 120 on the roller cutters 110 may cause each tooth to bear more load than an associated cutting element 116 on a fixed blade cutter 106, which may protect the fixed blade 106. In practice, it may be a combination of factors, such as the projection of each tooth 120 from the surface of the rolling cutter 110 or the angular spacing (pitch) between adjacent teeth, that governs whether the teeth 120 of a rolling cutter 110 actually bear more of the cutting load than an associated cutting element 116 on a fixed blade cutter 106. This concept may include what is referred to herein as "effective projection," which is described below with reference to FIGS. 9A and 9B.

Figure 9A:
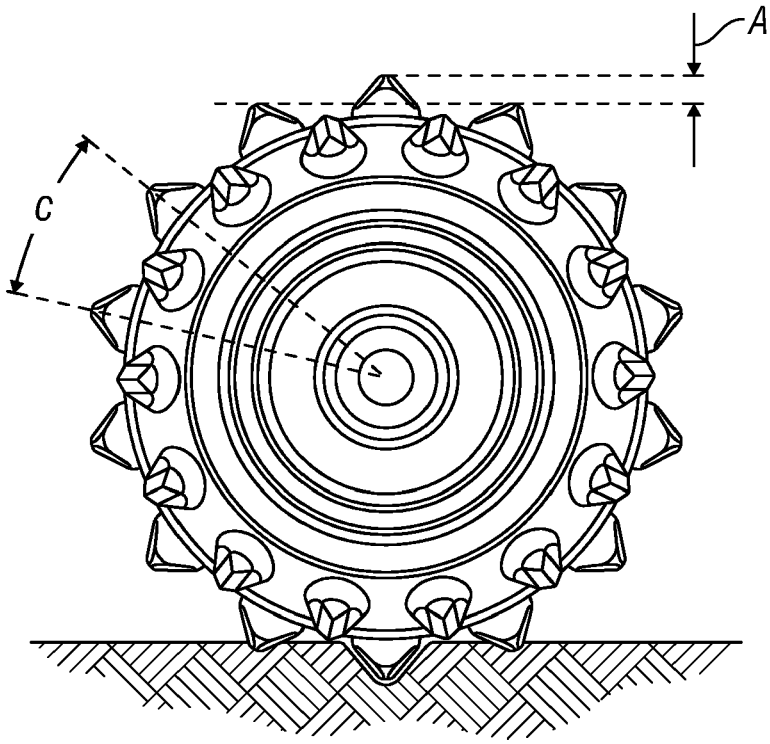
FIG. 9A illustrates one of many embodiments of a hybrid reamer having a rolling cutter having a limited effective projection and utilizing certain aspects of the present invention.
Figure 9B:
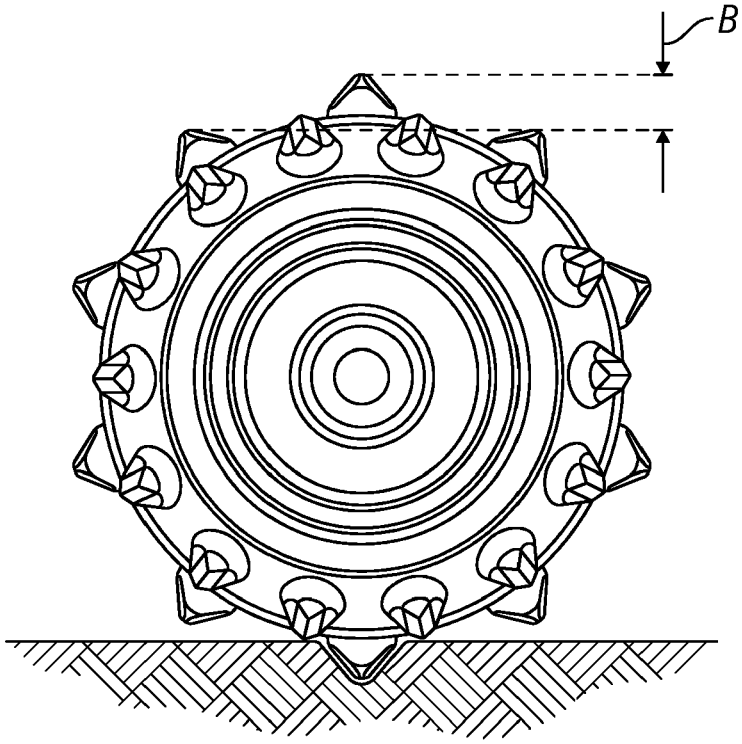
FIG. 9B illustrates one of many embodiments of a hybrid reamer having a rolling cutter having a full effective projection and utilizing certain aspects of the present invention.

FIG. 9A illustrates one of many embodiments of a reamer having a rolling cutter having a limited effective projection and utilizing certain aspects of the present invention. FIG. 9B illustrates one of many embodiments of a reamer having a rolling cutter having a full effective projection and utilizing certain aspects of the present invention. FIGS. 9A and 9B will be described in conjunction with one another. As shown in FIG. 9A, the effective projection A of a given cutting element of a rolling cutter, or that projection of the cutting element available to penetrate into earthen formation, may be limited by the projection of each adjacent cutting element and the angular distance or pitch C between each cutting element. FIG. 9B illustrates "full" effective projection B in that the pitch may be selected so that the adjacent cutting elements on either side of a given cutting element permit penetration of the given cutting element to a depth equal to its full projection from the surface of the rolling cutter. Typically, the greater the effective projection, the greater the aggressiveness of the rolling cutter may be.

From one or more of the exemplary embodiments described above, a method for designing a hybrid earth reaming bit of the present invention may permit or allow the cutting aggressiveness of the hybrid reamer to be varied. For example, the aggressiveness may be adjusted or selected based on the relationship between an associated pair of cutters, which may be any pair of cutters, such as a fixed blade cutter and a rolling cutter, or a plurality of fixed blade cutters and rolling cutters, and which may be in any direction. The relationship may include, for example, either axially, angularly, or otherwise, a fixed blade cutter leading a rolling cutter in a pair of cutters, a rolling cutter leading a fixed blade cutter in a pair of cutters or, as another example, a rolling cutter being located opposite a fixed blade cutter in a pair of cutters on the reamer. The relationship may, but need not, also include the angular relationship of a fixed blade cutter and a rolling cutter of a pair of cutters, which may give respect to, for example, the angular leading or trailing distance between two associated cutters. The cutting aggressiveness of a hybrid reamer of the present invention may be achieved by defining a cutting aggressiveness of a hybrid reamer in accordance with a particular application and the various combinations of pairs of fixed blade cutters and rolling cutters, when compared to each other and to different types of reamers or drill bits, such as those having all rolling cutters or all fixed blades. A comparison may include, for example, considerations such as the ratio of torque to WOB or the ratio of penetration rate to WOB, as required by a particular application and as will be appreciated by one of ordinary skill. The design of the cutting aggressiveness for a hybrid reamer of the present invention my involve any number of factors or steps, such as, for example, adjusting the angular distance between two associated cutters, adjusting the effective projection of one or more cutting elements on a cutter, fixed, rolling or otherwise, disposing one or more cutting elements in a particular path or, as another example, arranging a pair of cutters or reaming elements in one or more of a leading, trailing or opposing configuration. One or more embodiments of the present invention may be tailored to a particular application, as will be understood by one of ordinary skill in the art, for example, where a designer desires to increase or decrease the aggressiveness of the reamer based on any number of factors, such as torque, slip-stick, formation type, or other factors required by a particular application.

Figure 10:
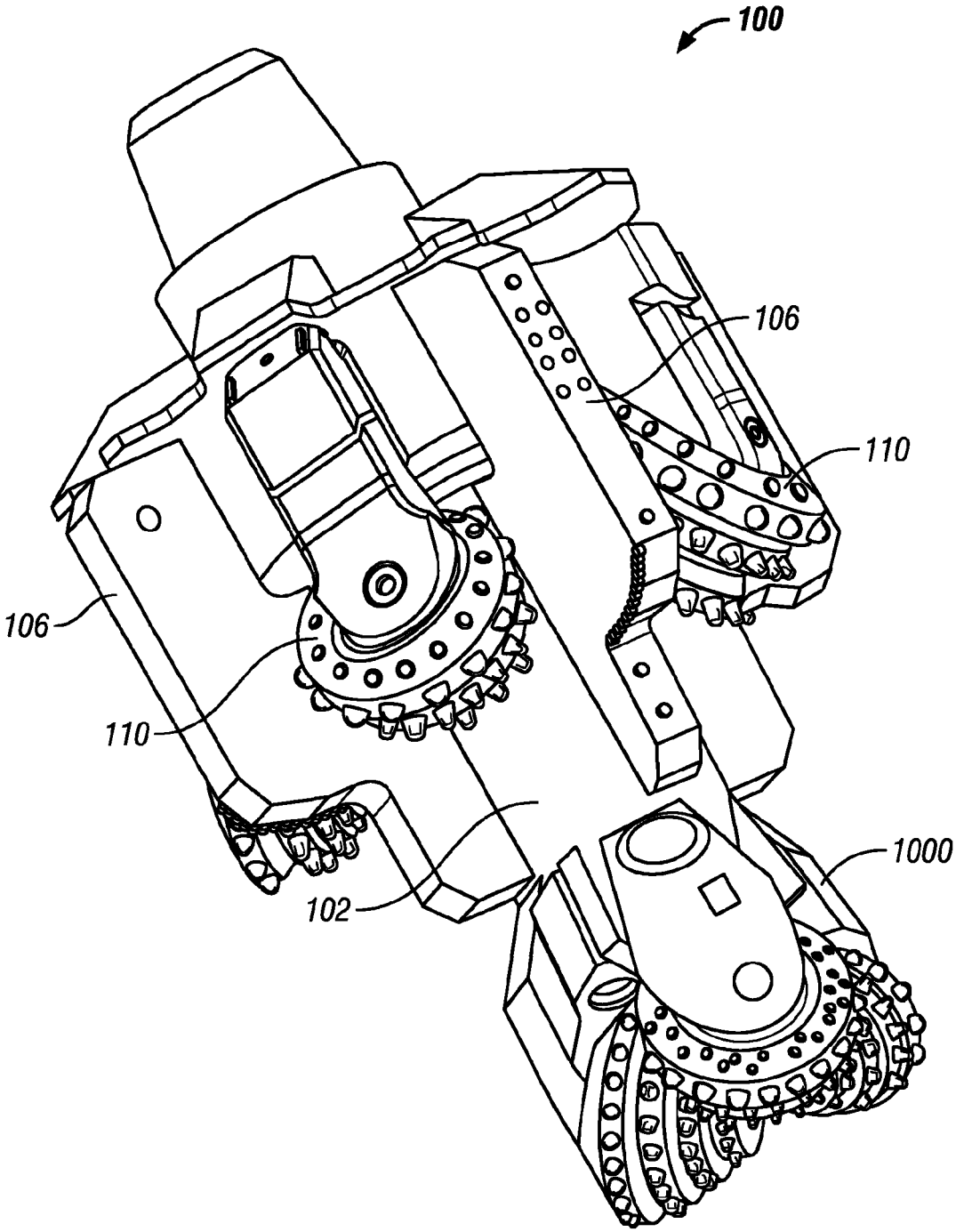
FIG. 10 illustrates one of many embodiments of a hybrid reamer having a pilot bit and utilizing certain aspects of the present invention.

FIG. 10 illustrates one of many embodiments of reamer 100 having a pilot bit 1000 and utilizing certain aspects of the present invention. As described above, reamer 100 may have a coupler 114 (FIG. 1) coupled to or formed on the downhole end of stem 102 for coupling reamer 100 to another piece of downhole equipment. For example, a plurality of reamers 100 may be coupled along a drill string, wherein each reamer 100 may have the same or different gage diameters, such as, for example, diameters that progressively increase in the uphole direction. As another example, the embodiment of FIG. 10, which is but one of many, shows a pilot bit 1000 integrally formed on the downhole end of reamer 100. While pilot bit 1000 is shown to be a tri-cone bit integrally formed on reamer 100, one of ordinary skill will understand that pilot bit 1000 may be any type of bit in accordance with a particular application, for example, a drag bit or hybrid bit, and, alternatively, may be formed separately from reamer 100 and coupled thereto using a coupler 114 (FIG. 1), in whole or in part. Pilot bit 1000 may be coupled to reamer 100 in any manner required by a particular application, such as threadingly, integrally, removably or otherwise, as will be understood by one of ordinary skill in the art. Pilot bit 1000 may be any size relative to a reaming dimension of reamer 100 and may preferably cut a pilot hole diameter that is less than the gage reaming diameter of reamer 100. The inner most reaming diameter of reamer 100 may, but need not, be less than or equal to the gage diameter of pilot bit 1000.

With further reference to FIG. 10, an embodiment of reamer 100 having a pilot bit 1000, such as the embodiment shown in FIG. 10, may be advantageous in one or more reaming applications. For example, in some applications requiring pilot bits, such as PDC bits, slip-stick may occur, such as when pilot bit 1000 is allowed to dig too deeply into the formation. One or more reamers 100, which may, but need not, be less aggressive than the pilot bit 1000 (as described above), may be coupled uphole from pilot bit 1000. A reamer 100 may at least partially counteract the aggressiveness of the pilot bit 1000, which may accomplish, for example, smoother overall drilling. For example, a relatively more aggressive pilot bit 1000 may tend to want to drill faster than an associated reamer 100, which may result in the transfer of drilling weight to one or more reamers 100 from pilot bit 1000. The one or more reamers 100, for example, may drill better under increased weight and/or may not exhibit slip-stick during operations, which may result in smoother operations. Other applications may not include the use of a pilot bit 1000. For example, the wellbore, or pilot hole, may be an existing drilled hole, such as a wellbore, mine, or other hole, wherein a pilot bit may not be necessary. For example, in a mine raising application, a pilot hole may already be present from one level to another in a mine. One or more reamers 100 may be coupled to the drill string at a lower level, for example, and drilling may occur in an uphole direction. The present invention may be advantageous in reducing or eliminating the need for drilling fluid to evacuate cuttings, reducing bottom hole pressure problems or, as another example, allowing gravity to keep the drilling surface clean.

The embodiments of reamer 100 shown and described herein are shown for exemplary purposes and one of ordinary skill will understand that a particular reamer 100 may be of any form required by a particular application, including one or more of those described herein, separately or in combination. Each reamer 100 utilized in a particular application may be coupled to, or proximate to, a pilot bit (FIG. 10), the BHA, or elsewhere in the drill string. In the exemplary embodiment of FIG. 10, for example, reamer 100 may include four fixed blades 106 and four rolling cutters 110 disposed radially around the central axis of reamer 100, for example, in an alternating fashion. Alternatively, reamer 100 may include any number of fixed blades 106 and rolling cutters 110, in any combination, as required by a particular application. As other examples, fixed blades 106 may include stabilizers or gage pads, which may or may not include cutting elements coupled thereto. Also, while some of the embodiments described herein, such as those shown in FIGS. 8A, 8B and 10, illustrate fixed blades 106 having cutting elements 116 that stop short (in the radially inward direction) of cutting tangentially to the outer surface of stem 102, other embodiments may include cutting elements 116 disposed substantially tangent to the outer surface of stem 102. As other examples, one or more embodiments may include cutting elements 116, 120 disposed on reamer 100 relative to the diameter of the pilot hole or the pilot bit that the reamer 100 may follow, on the outermost gage surfaces or disposed in any position therebetween, singularly or in combination, as required by a particular application.

Reamer 100 may include any number of fixed blades 106 and rolling cutters 110 arranged in any order required by a particular application. For example, reamer 100 may include two, four, or six of each type of cutter (fixed blade and rolling), which may, but need not, be coupled to body 103 in an alternating fashion. Each rolling cutter 110 and fixed blade 106 may be coupled to reamer 100 symmetrically or asymmetrically about the reamer axis of rotation. Where the cutters 106, 110 are coupled symmetrically, or are symmetric, the angular distances between each pair of adjacent cutters (e.g., between the centerlines of the cutters) are equal or substantially equal. For example, in a symmetrical embodiment of reamer 100 having four fixed blades 106 and four rolling cutters 110, which is but one of many, the angle formed about the reamer axis of rotation between each pair of adjacent cutters is 45 degrees or substantially 45 degrees. As another example, in a symmetrical embodiment of reamer 100 having three fixed blades 106 and three rolling cutters 110, which is but one of many, the angle formed about the reamer axis of rotation between each pair of adjacent cutters is 60 degrees or substantially 60 degrees. Alternatively, in at least one embodiment of reamer 100, such as the embodiment described below with respect to FIG. 11, one or more cutters 106, 110 may be coupled asymmetrically to reamer 100. Where a cutter is coupled asymmetrically to reamer 100, the angular distance between the asymmetric cutter and an adjacent cutter may be more or less than the angular distance would be in a symmetrical arrangement and the asymmetrical orientation may be enough to at least partially reduce harmful dynamics that may occur during reaming operations. For example, an asymmetric cutter may be coupled to reamer 100 so that its angular position about the reamer axis of rotation is different from its symmetrical position, which may include reference to cutters of the same type, a different type, or both.

Figure 11:
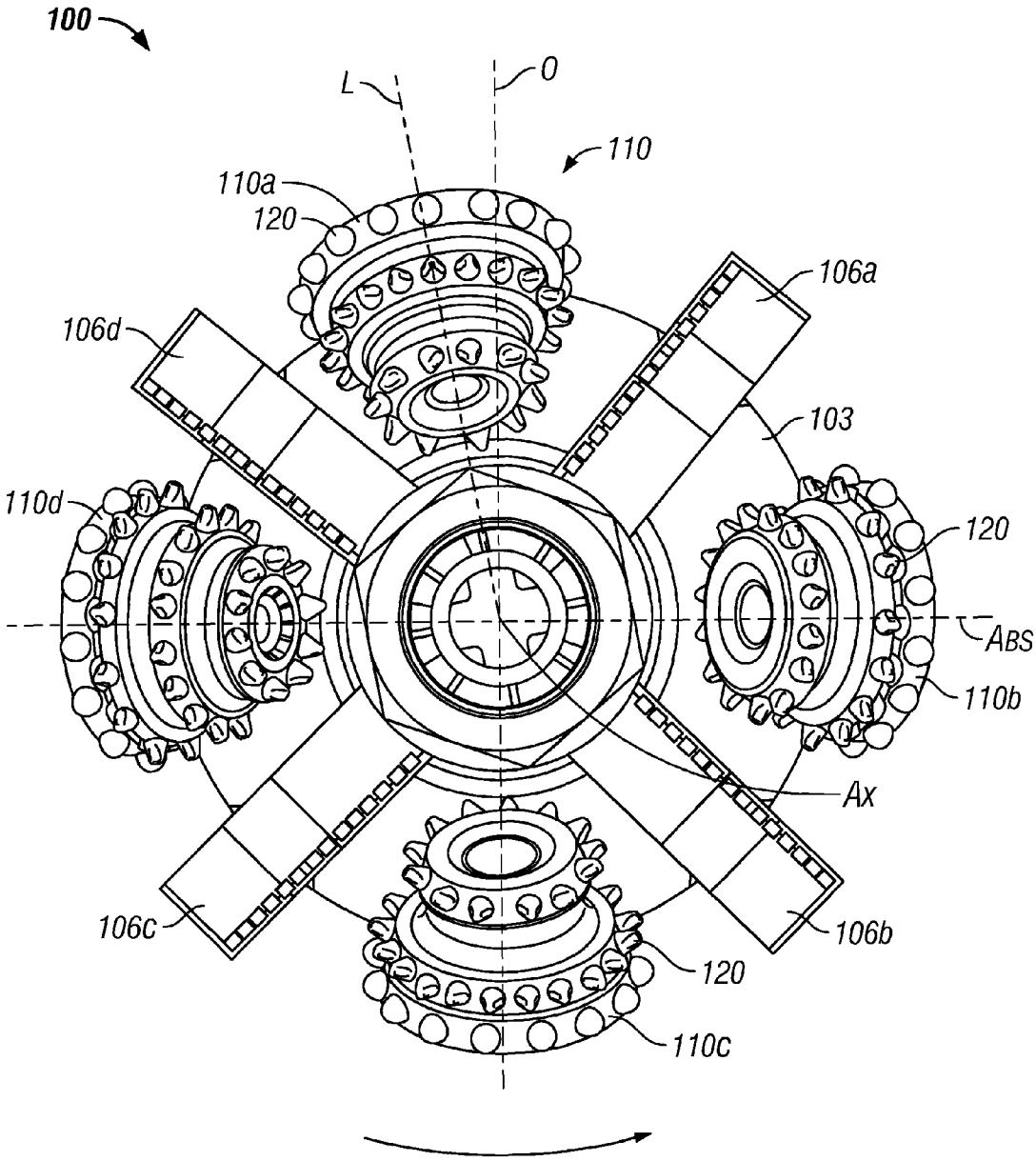
FIG. 11 illustrates one of many embodiments of a hybrid reamer having an asymmetrical cutter and utilizing certain aspects of the present invention.

FIG. 11 illustrates one of many embodiments of reamer 100 having an asymmetrical cutter and utilizing certain aspects of the present invention. In the particular embodiment of FIG. 11, but one of many, teeth 120 are shown to be inserts, but may be integral teeth as previously described herein, or any combination thereof. For convenience of explanation, the collective rolling cutters 110 are referred to herein separately as rolling cutters 110*a*-110*d*, while the collective fixed blades 106 are referred to separately as 106*a*-106*d*. Each rolling cutter 110 may include one or more rows of teeth 120 circumferentially disposed on its surface, which may be any number of rows required by a particular application. Rolling cutters 110*a* and 110*c*, and 110*b* and 110*d*, are substantially oppositely disposed from one another, as are fixed blades 106*a* and 106*c*, and 106*b* and 106*d*, respectively. For purposes of FIG. 11, the phrase "oppositely disposed" refers to cutters of the same type (i.e. rolling or fixed) that are separated by at least one cutter of the same type, whether or not separated by a cutter of a different type. For the purposes of reference and convenience, FIG. 11 includes a coordinate axis superimposed over reamer 100. The coordinate axis comprises an ordinate line O intersecting the reamer axis Ax and an abscissa line ABS intersecting the ordinate line O at the reamer axis Ax. In at least one embodiment of reamer 100, each cutter may be coupled symmetrically about axis Ax, as described above. In at least one other embodiment of reamer 100, such as the embodiment of FIG. 11, which is but one of many, at least one cutter may be coupled asymmetrically about axis Ax. As shown in FIG. 11, for example, the axes of rolling cutters 110*b*-*d* are substantially aligned with either the ordinate line O or the abscissa ABS. However, rolling cutter 110*a* is coupled such that its axis, shown aligned with line L, is not aligned with either the abscissa ABS or ordinate line O. Thus, rolling cutter 110*a* is one example of a cutter asymmetrically coupled to body 103 about axis Ax. FIG. 11 is one of many examples of an asymmetric embodiment of reamer 100, which may reduce harmful dynamics that may occur during reaming operations. Although a single rolling cutter 110 is shown in FIG. 11 in an asymmetric orientation, any number of additional rolling cutters 110 or fixed blades 106 may, but need not, be asymmetrically disposed at any angle required by a particular application.

Figure 12:
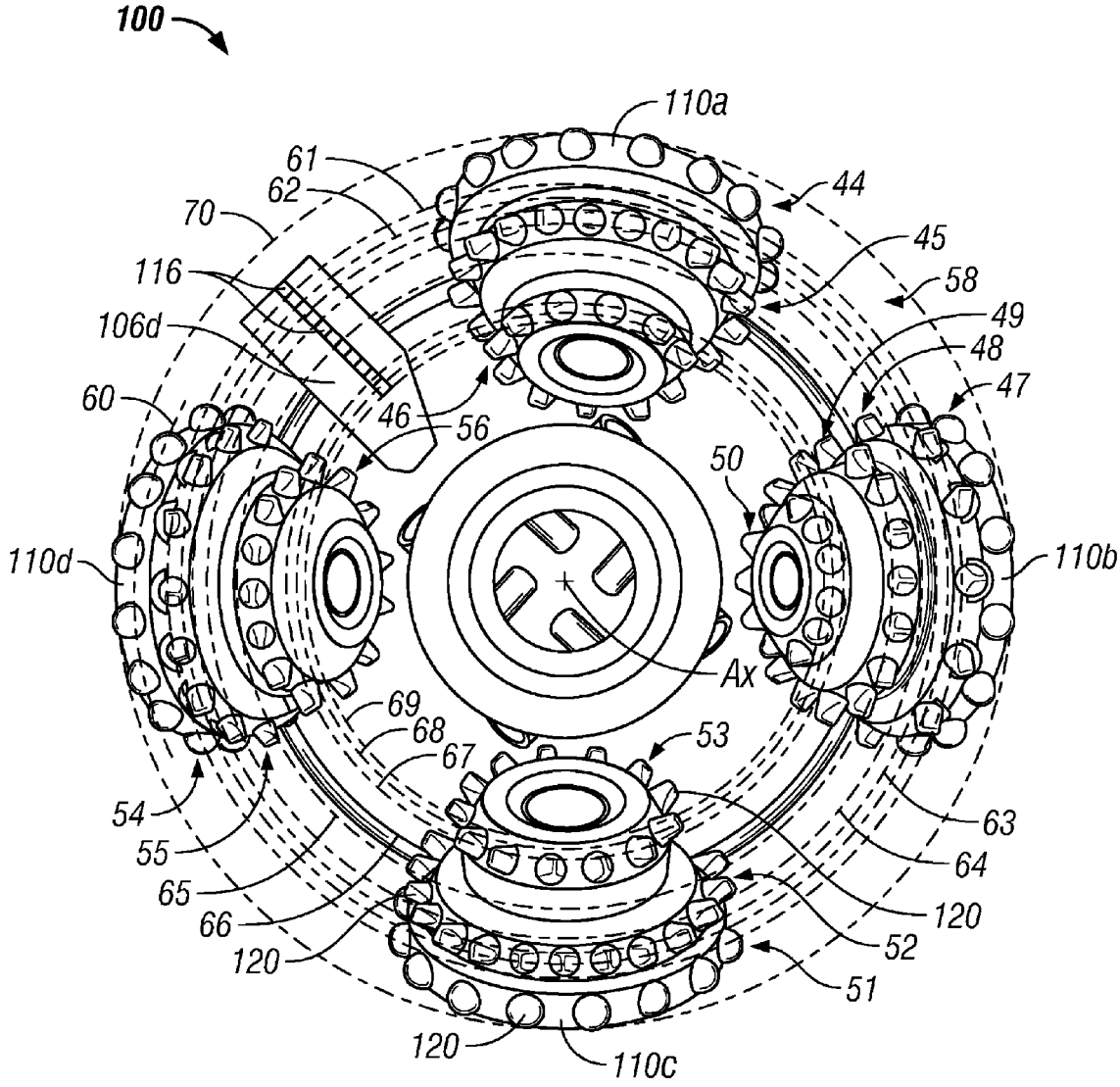
FIG. 12 illustrates one of many embodiments of a hybrid reamer in contact with a cutting surface and utilizing certain aspects of the present invention.

FIG. 12 illustrates one of many embodiments of reamer 100 in contact with a cutting surface 58 and utilizing certain aspects of the present invention. Fixed blades 106*a*-106*c* have been omitted from FIG. 12 only for purposes of clarity and explanation. As illustrated in the embodiment of FIG. 12, which is but one of many, the cutting surface 58 includes a series of concentrically arranged imaginary circles representing paths that may be formed by the rows of cutting elements 116, 120 in the cutting surface 58 during reaming. The paths shown in the particular embodiment of FIG. 12 are for illustrative purposes only and it should be understood that the paths may vary from application to application. In one example of the many uses of the embodiments and methods herein described, a sequence of rows may be correlated with corresponding or associated paths. For purposes of reference, the paths of FIG. 12 are referred to as the outermost gage diameter 70, the first outermost path 60, the second outermost path 61, the third outermost path 62, the fourth outermost path 63, the fifth outermost path 64, the sixth outermost path 65, the seventh outermost path 66, the eighth outermost outmost path 67, the ninth outermost outmost path 68 and the tenth outermost path 69. As shown in FIG. 11, each rolling cutter 110*a*-110*d* is identified by a reference numeral. In the example illustrated in FIG. 12, path 60 is formed by the heel rows 44, 47, 51, 54 of rolling cutters 110*a*, 110*b*, 110*c* and 110*d*, respectively. Path 61 is formed by the first inner row 55 of rolling cutter 110*d*. Path 62 is formed by the first inner row 48 on rolling cutter 110*b*. Path 63 is formed by the first inner row 52 on one 110*c*. Path 64 is formed by the first inner row 45 on rolling cutter 110*a*. Path 65 is formed by the second inner row 49 on rolling cutter 110*b*. Path 66 is formed by the second inner row 56 on rolling cutter 110*d*. Path 67 is formed by the second inner row 53 on rolling cutter 110*c*. Path 68 is formed by the second inner row 46 on rolling cutter 110*a*. Path 69 is formed by the third inner row 50 on rolling cutter 110*b*. As can be seen from this example, which is but one of many, adjacent paths are associated with rows from oppositely disposed rolling cutters 110. However, one of ordinary skill will understand that this need not always be the case and that any number of combinations of rows, teeth, rolling cutters and paths is possible, as required by a particular application and contemplated by the present disclosure. One of ordinary skill will understand that any number of cutting elements 116 may be coupled to fixed blades 106*a*-106*c* (not shown) and 106*d*, one or more of which may be disposed in any one of the paths, as required by a particular application. Alternatively, cutting elements 116 may define the paths described with respect to FIG. 11 and each row of teeth 120 may follow therein (e.g., a fixed blade leading configuration).

With further reference to FIG. 12, other aspects of the present invention will be discussed. In the embodiment of FIG. 12, the outermost portions of heel rows 44, 47, 51, 54 of rolling cutters 110*a*, 110*b*, 110*c* and 110*d*, respectively, define the outermost gage diameter 70. In this particular example, the outermost fixed blade cutting elements 116 and gage surfaces of fixed blades 106 do not reach the gage diameter 70 and therefore may not cut the gage surface. This configuration of reamer 100, which is but one of many, may protect the fixed blades 106 from wear or breakage, for example, in applications where the rolling cutters 110 are more suitable for cutting the gage surface of the wellbore. Another embodiment having this configuration is shown in FIG. 8H, wherein the rolling cutters 110 cut the gage surface and are otherwise formed to match the rounded or curved cutting profiles of the fixed blades 106. As another example, FIG. 8C shows an embodiment of reamer 100 wherein the rolling cutters 110 cut the gage surface and are otherwise formed to match the substantially linear cutting profiles of the fixed blades 106. One of ordinary skill will understand that this need not always be the case. For example, FIGS. 5-7 show embodiments wherein the gage section of the cutting profiles of the fixed blades 106 and rolling cutters 110 match so that the fixed blades and rolling cutters cut the gage surface simultaneously. In one or more other embodiments, such as shown in FIG. 4, the gage diameter of the rolling cutters 110 may be less than that of the fixed blades 106 so that only the fixed blades 106 cut the gage diameter of the wellbore, as required by a particular application.

Other and further embodiments utilizing one or more aspects of the invention described above can be devised without departing from the spirit of my invention. For example, the rolling cutters or fixed blades may be coupled to a reamer body that is coupled to the stem so that it may be removed after use and/or replaced such that the stem may be reused downhole or elsewhere. In addition, while the reamer tools were described herein as having fixed diameters, the components associated therewith may be moveable or expandable, such as through the use of drilling fluid or mechanical devices. Further, the various methods and embodiments of the pilot reamer can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of my invention, but rather, in conformity with the patent laws, we intend to fully protect all such modifications and improvements that come within the scope or range of equivalent of the following claims.

What is claimed is:

1. A hole opener having a hybrid reaming section for downhole earth boring operations comprising:

a reamer body having a central longitudinal axis of rotation, an outer periphery, and upper and lower ends;

a plurality of rolling cutter mounts coupled to the outer periphery about the longitudinal axis and depending downwardly;

a rolling cutter rotatably coupled to each mount, the rolling cutters defining a rolling cutter cutting profile having a rolling cutter cutting diameter;

a plurality of fixed blade cutters coupled to the outer periphery and defining a fixed blade cutter cutting profile having a fixed blade cutter cutting diameter, each fixed blade cutter being coupled between adjacent rolling cutter mounts;

wherein at least one of the rolling cutters is asymmetrically coupled about the longitudinal axis; and wherein the rolling cutter cutting diameter is larger than the fixed blade cutter cutting diameter.

2. The hole opener of claim 1, wherein the body is tubular.

3. The hole opener of claim 1, further comprising a coupler coupled to the body lower end.

4. The hole opener of claim 1, wherein an angular distance between the asymmetrically coupled rolling cutter and a nearest trailing fixed blade cutter is less than an angular distance between the asymmetrically coupled rolling cutter and a nearest leading fixed blade cutter with respect to the direction of rotation.

5. The hole opener of claim 1, wherein an angular distance between the asymmetrically coupled rolling cutter and a nearest leading fixed blade cutter is less than an angular distance between the asymmetrically coupled rolling cutter and a nearest trailing fixed blade cutter with respect to the direction of rotation.

6. The hole opener of claim 1, further comprising a stem extending through the body and below the body lower end.

7. The hole opener of claim 6, wherein the fixed blade cutter cutting profile extends to the stem.

8. The hole opener of claim 1, wherein the fixed blade cutter cutting profile and the rolling cutter cutting profile collectively define a combined cutting profile, at least a portion of the combined cutting profile being curved.

9. The hole opener of claim 1, wherein at least a portion of the fixed blade cutter cutting profile matches at least a portion of the rolling cutter cutting profile.

10. A hole opener having a hybrid reaming section for downhole earth boring operations comprising:

a reamer body having a central longitudinal axis of rotation, an outer periphery, and upper and lower ends;

a plurality of rolling cutter mounts coupled to the outer periphery about the longitudinal axis and depending downwardly;

a rolling cutter rotatably coupled to each mount, the rolling cutters defining a rolling cutter cutting profile having an outermost rolling cutter cutting diameter;

a plurality of fixed blade cutters coupled to the outer periphery and defining a fixed blade cutter cutting profile having an outermost fixed blade cutter cutting diameter, each fixed blade cutter being coupled between adjacent rolling cutter mounts; and wherein at least a portion of the rolling cutter cutting profile is deeper than the fixed blade cutter cutting profile and wherein the outermost rolling cutter cutting diameter is larger than the outermost fixed blade cutter cutting diameter.

11. The hole opener of claim 10, wherein the body is tubular.

12. The hole opener of claim 10, further comprising a coupler coupled to the body lower end.

13. The hole opener of claim 10, further comprising a stem extending through the body and below the body lower end.

14. The hole opener of claim 13, wherein the fixed blade cutter cutting profile extends to the stem.

15. The hole opener of claim 10, wherein the fixed blade cutter cutting profile and the rolling cutter cutting profile collectively define a combined cutting profile, at least a portion of the combined cutting profile being curved.

16. The hole opener of claim 10, wherein at least a portion of the fixed blade cutter cutting profile matches at least a portion of the rolling cutter cutting profile.

17. A hole opener having a hybrid reaming section for downhole earth boring operations comprising:

a reamer body having a central longitudinal axis of rotation, an outer periphery, and upper and lower ends;

a plurality of rolling cutter mounts coupled to the outer periphery about the longitudinal axis and depending downwardly;

a rolling cutter rotatably coupled to each mount, the rolling cutters defining a rolling cutter cutting profile having an outermost rolling cutter cutting diameter;

a plurality of fixed blade cutters coupled to the outer periphery and defining a fixed blade cutter cutting profile having an outermost fixed blade cutter cutting diameter, each fixed blade cutter being coupled between adjacent rolling cutter mounts;

wherein at least one of the rolling cutters is coupled asymmetrically about the longitudinal axis; and wherein at least a portion of the rolling cutter cutting profile is deeper than the fixed blade cutter cutting profile and wherein the outermost rolling cutter cutting diameter is larger than the outermost fixed blade cutter cutting diameter.

* * * * *